US006637415B2

(12) United States Patent
Yoshioka et al.

(10) Patent No.: US 6,637,415 B2
(45) Date of Patent: Oct. 28, 2003

(54) EVAPORATIVE FUEL LEAKAGE PREVENTING DEVICE FOR INTERNAL COMBUSTION ENGINE

(75) Inventors: Mamoru Yoshioka, Susono (JP); Yoshihiko Hyodo, Gotemba (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 98 days.

(21) Appl. No.: 09/986,100

(22) Filed: Nov. 7, 2001

(65) Prior Publication Data

US 2002/0059920 A1 May 23, 2002

(30) Foreign Application Priority Data

| | | |
|---|---|---|
| Nov. 17, 2000 | (JP) | 2000-351565 |
| Nov. 20, 2000 | (JP) | 2000-353161 |
| Dec. 14, 2000 | (JP) | 2000-380683 |
| Dec. 19, 2000 | (JP) | 2000-385751 |

(51) Int. Cl.[7] ..... F02M 33/02
(52) U.S. Cl. ..... 123/518; 123/198 E
(58) Field of Search ..... 123/518, 519, 123/520, 516, 198 D, 521, 198 E

(56) References Cited

U.S. PATENT DOCUMENTS

| | | | | |
|---|---|---|---|---|
| 4,300,511 A | * | 11/1981 | Lang | 123/520 |
| 5,472,463 A | * | 12/1995 | Herman et al. | 55/319 |

FOREIGN PATENT DOCUMENTS

| | | |
|---|---|---|
| JP | A 55-75561 | 6/1980 |
| JP | A 56-14834 | 2/1981 |
| JP | U 60-137162 | 9/1985 |
| JP | Y2 7-696 | 1/1995 |
| JP | A 11-82192 | 3/1999 |

* cited by examiner

*Primary Examiner*—Mahmond Gimie
(74) *Attorney, Agent, or Firm*—Oliff & Berridge PLC

(57) ABSTRACT

An evaporative fuel leakage preventing device is designed such that an adsorbent is disposed in an intake passage so as to adsorb evaporative fuel generated in the intake passage during stoppage of the engine and prevent evaporative fuel from being discharged to the atmosphere. The device prevents evaporative fuel that has been previously adsorbed by the adsorbent, and that is desorbed from the adsorbent due to the ambient temperature while the engine is not in operation, from being emitted to the atmosphere even when the engine is not in operation.

7 Claims, 22 Drawing Sheets

EVAPORATIVE FUEL LEAKAGE PREVENTING DEVICE FOR INTERNAL COMBUSTION ENGINE

INCORPORATION BY REFERENCE

The disclosures of Japanese Patent Applications No. 2000-380683 filed on Dec. 14, 2000, No. 2000-351565filed on Nov. 17, 2000, No. 2000-353161 filed on Nov. 20, 2000, and No. 2000-385751 filed on Dec. 19, 2000, each including the specification, drawings and abstract are incorporated herein by reference in their entireties.

BACKGROUND OF THE INVENTION

1. Field of Invention

The invention relates to an evaporative fuel leakage preventing device for an internal combustion engine. More particularly, the invention relates to an evaporative fuel leakage preventing device capable of preventing evaporative fuel from being discharged to the atmosphere from an intake passage during stoppage of an internal combustion engine.

2. Description of Related Art

When an internal combustion engine is out of operation, evaporative fuel is generated in an intake passage of the engine for various reasons. For instance, if fuel supplied to a combustion chamber of a certain cylinder during operation of the engine fails to burn and accumulates in the cylinder when the engine is stopped, the fuel evaporates in the cylinder during stoppage of the engine, so that evaporative fuel is generated. Accordingly, if there is at least one cylinder with open intake valves during stoppage of the engine, evaporative fuel flows from the cylinder into the intake passage and fills it up. Further, if fuel adherent to a wall surface of an intake port in its liquid state during operation of the engine remains when the engine is stopped, the fuel evaporates during stoppage of the engine, so that evaporative fuel forms in the intake passage. In addition, in the case of an engine having fuel injection valves, a small amount of fuel accumulating in each fuel injection valve during stoppage of the engine may leak out to an intake passage and turn into evaporative fuel therein.

If evaporative fuel is thus generated in the intake passage during stoppage of the engine, the evaporative fuel thus generated fills up the intake passage and leaks out to the atmosphere from an opening (suction inlet) in the intake passage. In such a case, hydrocarbon and so on contained in the evaporative fuel may cause air pollution.

In order to prevent evaporative fuel from being discharged from the intake passage during stoppage of the engine (i.e., to prevent "intake leakage emission"), there is proposed an evaporative fuel leakage preventing device that has an adsorbent such as activated carbon disposed in an intake passage of an engine and that causes the adsorbent to adsorb evaporative fuel generated in the intake passage during stoppage of the engine so as to prevent the evaporative fuel from being discharged to the atmosphere.

For example, Japanese Patent Application Laid-Open No. 11-82192 discloses one such evaporative fuel leakage preventing device. The evaporative fuel leakage preventing device disclosed in this publication has an adsorbent disposed between a throttle valve in an intake passage and a main body of an engine, and the adsorbent is capable of adsorbing evaporative fuel produced through evaporation of fuel leaking out from a fuel injection valve during stoppage of the engine. The evaporative fuel leakage preventing device disclosed in the publication is designed such that evaporative fuel generated in the intake passage, for example, during stoppage of the engine is adsorbed by the adsorbent and is thus prevented from being discharged therefrom to the atmosphere. Consequently, evaporative fuel is prevented from being discharged to the atmosphere during stoppage of the engine. Further, if the engine is operated next time, the adsorbent is desorbed (purged) of evaporative fuel adsorbed thereby due to intake air (sucked air) flowing through the adsorbent, and the evaporative fuel is supplied to the engine together with intake air and bums. Thus, the adsorbent is prevented from becoming saturated with evaporative fuel adsorbed thereby.

However, in the case of Japanese Patent Application Laid-Open No. 11-82192 mentioned above, evaporative fuel is discharged to the atmosphere from an inlet of the intake passage under certain circumstances and causes intake leakage emission. For example, if an adsorbent such as activated carbon or the like adsorbs evaporative fuel and then is heated up, it discharges a part of the adsorbed evaporative fuel due to a decrease in its evaporative fuel adsorbing capacity. Hence, the device disclosed in Japanese Patent Application Laid-Open No. 11-82192 has the following problem. Namely, if the ambient temperature rises during stoppage of the engine, a part of the evaporative fuel adsorbed by the adsorbent is discharged therefrom to the atmosphere through the inlet of the intake passage.

SUMMARY OF THE INVENTION

It is one object of the invention to find a solution to the aforementioned problems and provide an evaporative fuel leakage preventing device that prevents leakage of evaporative fuel when the adsorbent rises in temperature due to a rise in ambient temperature during stoppage of an internal combustion engine.

In order to achieve the aforementioned and/or other objects, one aspect of the invention provides an evaporative fuel leakage preventing device for an internal combustion engine in which an adsorbent for adsorbing evaporative fuel is disposed in an intake passage of the internal combustion engine, wherein the adsorbent adsorbs evaporative fuel generated in the intake passage during stoppage of the engine. In addition, the adsorbent is purged of the evaporative fuel adsorbed thereby due to intake air in the engine during operation thereof so that the evaporative fuel is sucked into the internal combustion engine. In this evaporative fuel leakage preventing device, an atmospheric suction inlet of the intake passage is formed on a side of the adsorbent opposite to a direction in which evaporative fuel generated in the intake passage moves due to application of a gravitational force. The adsorbent is purged (desorbed) of evaporative fuel adsorbed by the adsorbent due to intake air in the internal combustion engine during operation of the internal combustion engine, so that the evaporative fuel is sucked into a cylinder of the internal combustion engine.

That is, the above-mentioned evaporative fuel leakage preventing device is designed such that the adsorbent disposed in the intake passage of the internal combustion engine adsorbs and holds evaporative fuel produced through evaporation of fuel during stoppage of the engine, thus preventing evaporative fuel from being discharged to the atmosphere from the suction inlet. Further, if the ambient temperature rises during stoppage of the engine, a part of the adsorbed evaporative fuel is discharged from the adsorbent. However, since evaporative fuel is heavier than air, the discharged evaporative fuel accumulates in a region close to a lower portion of the adsorbent or is returned to the inside of the internal combustion engine due to application of a gravitational force. Thus, evaporative fuel does not flow out to the outside from the atmospheric suction inlet. Accordingly, generation of intake leakage emission during stoppage of the engine, that is, leakage of evaporative fuel, is prevented.

BRIEF DESCRIPTION OF THE DRAWINGS

The above-mentioned and other objects, features, advantages, and technical and industrial significance of the invention will be better understood by reading the following detailed description of the preferred embodiments of the invention, when considered in connection with the accompanying drawings, in which.

DETAILED DESCRIPTION OF PREFERRED EMBODIMENTS

In the following description and the accompanying drawings, the invention will be described in more detail with reference to exemplary, preferred embodiments.

Figure 1:
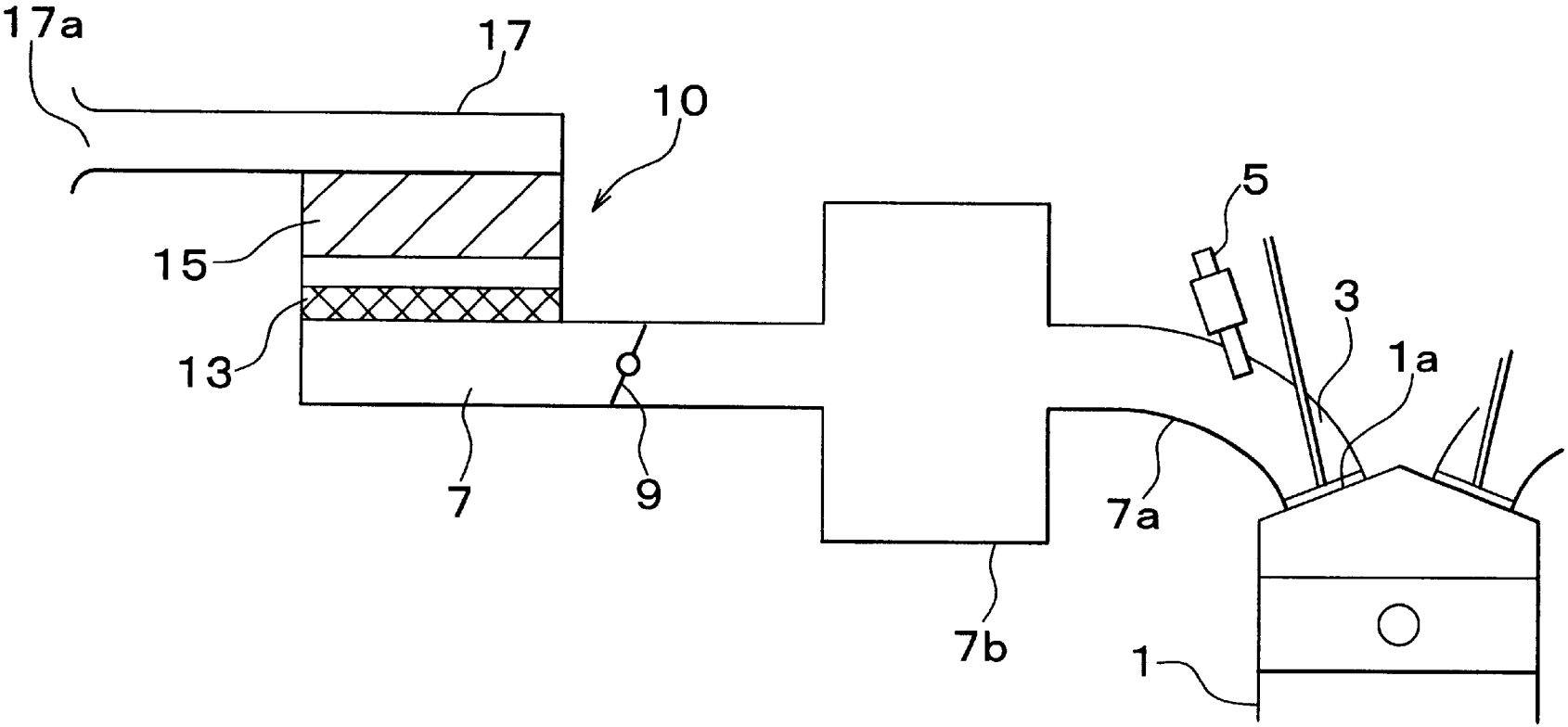
FIG. 1 illustrates the overall structure of an intake system according to a first embodiment of the invention.

First of all, a first embodiment of the invention will be described. FIG. 1 illustrates the overall structure of the first embodiment of the invention.

FIG. 1 shows a cylinder 1 of an internal combustion engine, an intake valve 1*a* of the cylinder, and an intake port 3. The intake port of each cylinder is connected to a surge tank 7*b* via an intake manifold 7*a*. The surge tank 7*b* is connected to a nozzle 17 via an intake passage 7 and an air cleaner 10. A throttle valve 9 is disposed in the intake passage 7.

A fuel injection valve 5 injects fuel supplied from a fuel supplying line (not shown) into each intake port while the engine is in operation, and introduces the fuel into each cylinder together with intake air. The air cleaner 10 is provided with a filter element 15, and an adsorbent layer 13 made from silica gel, activated carbon or the like is disposed below the filter element 15. Further, the first embodiment is designed such that the intake passage 7 is connected to the air cleaner 10 at a position below the adsorbent layer 13 and that the nozzle 17 is connected to the air cleaner 10 at a position above the filter element 15. That is, the air that has been sucked into the nozzle 17 during operation of the engine flows into the filter element 15 from above, through the adsorbent layer 13 disposed below the filter element 15, and into the intake passage 7 below the adsorbent layer 13. Further, an air suction inlet 17*a* of the nozzle 17 is located higher than the adsorbent layer 13.

During operation of the engine, a part of fuel injected from the fuel injection valve 5 adheres to a wall surface of the intake port 3 while remaining in its liquid state, thus forming wall-surface adherent fuel. This wall-surface adherent fuel gradually evaporates after stoppage of the engine and becomes evaporative fuel. Further, during stoppage of the engine, fuel held inside the fuel injection valve, although small in amount, may leak out to the intake port. In other words, so-called incomplete oil tightness of the fuel injection valve may occur. The fuel that has flown out to the intake port due to incomplete oil tightness evaporates during stoppage of the engine and becomes evaporative fuel as in the case of wall-surface adherent fuel. Hence, the intake port 3, the intake manifold 7*a*, the surge tank 7*b*, and the intake passage 7 are filled with evaporative fuel during stoppage of the engine.

Hence, in general, fuel in the intake passage 7 flows out to the atmosphere from the suction inlet 17*a* of the nozzle 17 during stoppage of the engine, thus causing a problem of generating so-called intake leakage emission. This embodiment is designed to provide the adsorbent layer 13 capable of adsorbing evaporative fuel in the air cleaner 10 so as to prevent generation of intake leakage emission during stoppage of the engine. Because the adsorbent layer 13 is provided, evaporative fuel filling up the intake passage 7 is adsorbed by an adsorbent when flowing through the adsorbent layer 13, and is prevented from being discharged to the atmosphere from the suction inlet 17*a* of the nozzle 17. Therefore, no intake leakage emission is generated.

However, evaporative fuel adsorbed by the adsorbent layer 13 is discharged from the adsorbent, for example, if the ambient temperature rises. Hence, if a rise in ambient temperature or the like is caused during stoppage of the engine, a part of evaporative fuel that has once been adsorbed by the adsorbent layer 13 is discharged from the adsorbent layer 13.

In this embodiment, as shown in FIG. 1, the suction inlet 17*a* of the nozzle 17 is disposed higher than the adsorbent layer 13 and the intake passage 7 connected to the adsorbent layer 13. Further, since evaporative fuel is composed of hydrocarbon having a relatively heavy molecular weight, the specific weight of evaporative fuel is heavier than the specific weight of air. Therefore, this embodiment is designed such that, if evaporative fuel is discharged from the adsorbent layer 13 due to a rise in temperature during stoppage of the engine or the like, the discharged evaporative fuel accumulates in the intake passage in a region below the adsorbent layer 13 without leaking to a region above the adsorbent layer 13. That is, since this embodiment is designed to dispose the suction inlet 17*a* of the nozzle 17 higher than the adsorbent layer 13 and the intake passage 7 connected to the adsorbent layer 13, no evaporative fuel is discharged to the atmosphere from the suction inlet 17*a* even if the ambient temperature has risen during stoppage of the engine. Thus, it is possible to prevent generation of intake leakage emission completely.

Figure 6:
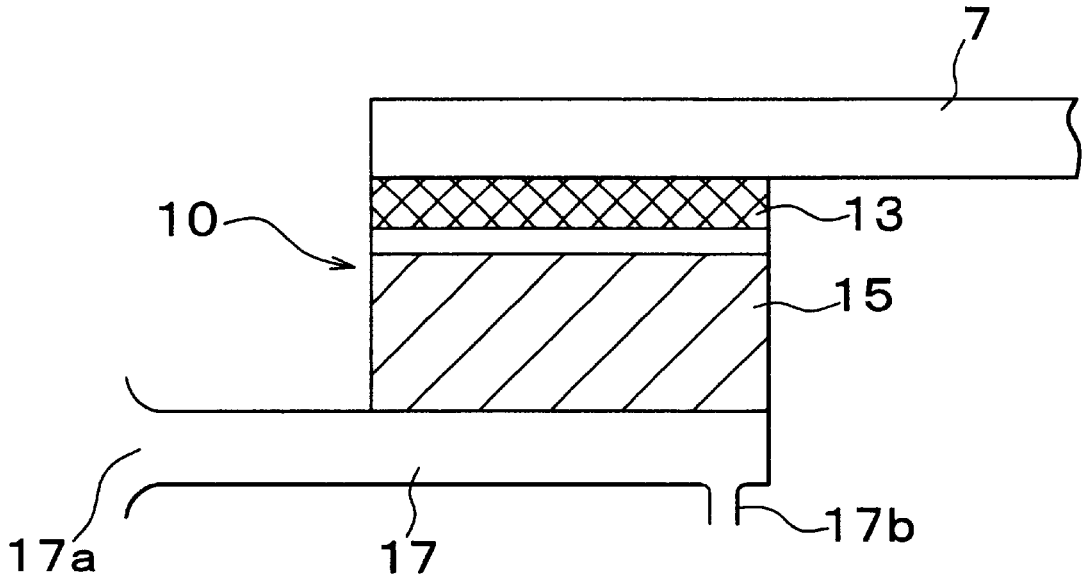
FIG. 6 PRIOR ART
FIG. 6 shows the structure of a conventionally employed intake system.

FIG. 6 is a view that is similar to FIG. 1 and that shows a positional relation in the vertical direction among a nozzle, an air cleaner, and an intake passage of a conventionally employed type of adsorbent. In general, the intake passage 7 is connected to an upper portion of the air cleaner 10 whereas the nozzle 17 is connected to a lower portion of the air cleaner 10. Such a structure is effective in providing a drain port 17*b* in the nozzle 17 (below the air cleaner 10) for example as shown in FIG. 6 and thus preventing water drops resulting from rain, splash, or the like from entering the intake passage 7. However, according to such a conventionally employed structure, if the adsorbent layer 13 is provided for example above the filter element 15, the suction inlet 17*a* of the nozzle 17 opens at a position lower than the adsorbent layer 13 and the intake passage 7 connected to the adsorbent layer 13. Hence, evaporative fuel discharged from the adsorbent layer 13 due to a rise in ambient temperature or the like during stoppage of the engine flows from the adsorbent layer 13 through the filter element 15 into the nozzle 17 below the filter element 15, and is discharged to the atmosphere through the suction inlet 17*a* of the nozzle. Thus, it is impossible to prevent generation of intake leakage emission during stoppage of the engine.

The embodiment shown in FIG. 1 is designed such that the suction inlet 17*a* of the nozzle 17 is located higher than the adsorbent layer 13 and the intake passage 7 connected to the lower portion of the adsorbent layer 13. Thus, the entire evaporative fuel discharged from the adsorbent layer 13 accumulates in the intake passage 7 disposed below the adsorbent layer 13, so that no intake leakage emission is generated.

Next, a first modification of the first embodiment will be described. The embodiment shown in FIG. 1 is designed such that the suction inlet 17*a* of the nozzle 17 is located higher than the adsorbent layer 13 and the intake passage 7 connected to the lower portion of the adsorbent layer 13 so that the entire evaporative fuel discharged from the adsorbent layer 13 accumulates in the intake passage 7 disposed below the adsorbent layer 13, thus preventing evaporative fuel from leaking out to the atmosphere from the suction inlet 17*a* of the nozzle disposed above the adsorbent layer 13.

On the other hand, this first modification is designed such that evaporative fuel discharged from the adsorbent during stoppage of the engine is introduced into a return portion of the intake passage that is disposed still lower than the adsorbent, thus preventing evaporative fuel from leaking out to the atmosphere from the suction inlet 17*a* of the nozzle.

Figure 2:
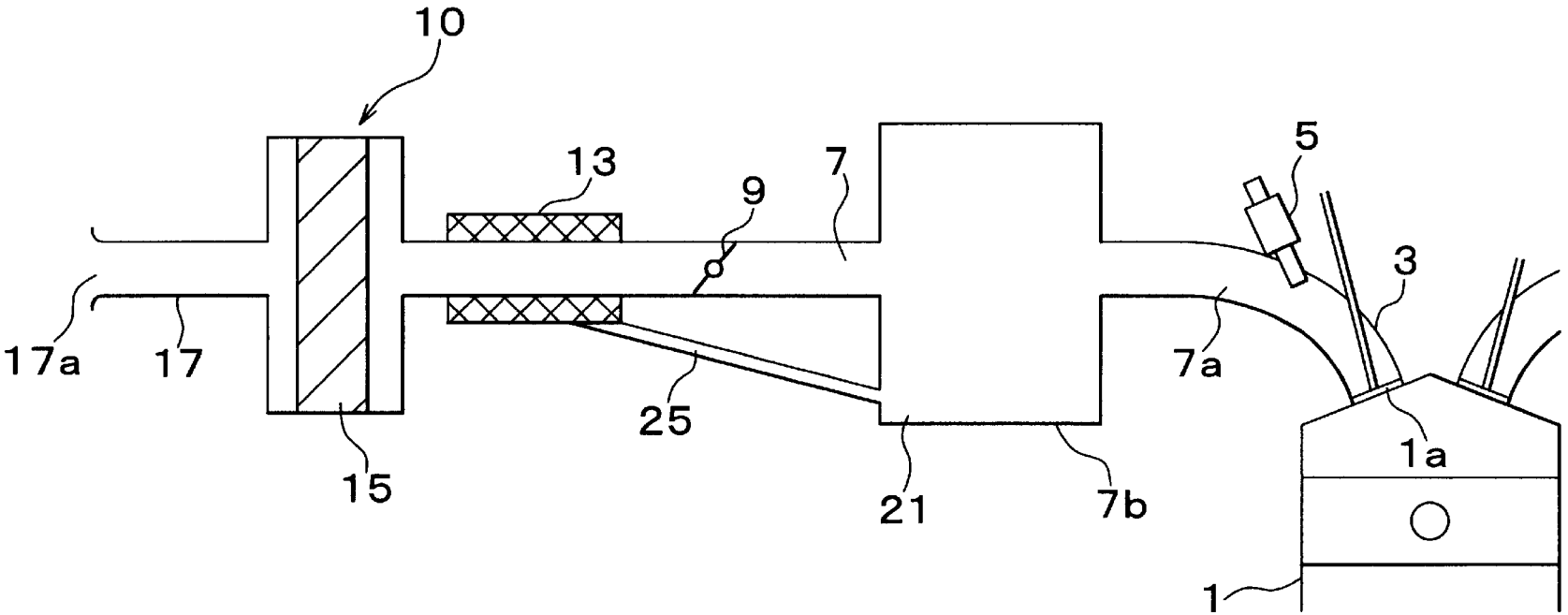
FIG. 2 is an overall structural view of a first modification of the first embodiment.

FIG. 2 is a view that is similar to FIG. 1 and that illustrates the overall structure of the first modification. In FIGS. 1 and 2, like components are denoted by like reference symbols.

The modification shown in FIG. 2 is designed such that the intake passage 7, the air cleaner 10, and the suction inlet 17*a* of the nozzle 17 are located substantially on the same level. The adsorbent 13 made from silica gel, activated carbon, or the like is not disposed in the air cleaner 10 but is formed into a cylindrical shape so as to encircle the intake passage 7. That is, the adsorbent 13 of this modification is designed such that the cylindrically shaped adsorbent is interposed at opposed ends thereof midway through the intake passage 7 so as to constitute an inner wall surface of the intake passage. This embodiment is not designed such that evaporative fuel flows through the adsorbent 13, but is designed such that evaporative fuel in the intake passage 7 is adsorbed by the adsorbent 13 when coming into contact with the inner wall surface of the intake passage constituted by the adsorbent.

The structure of such an adsorbent of a contact-adsorption type demonstrates a smaller amount of adsorption per unit area facing the intake passage, as compared with the type shown in FIG. 1 in which evaporative fuel flows through the adsorbent (penetration-adsorption type). However, the structure of the adsorbent of contact-adsorption type makes it possible to enlarge a contact area by increasing the length along the intake passage without increasing the loss of intake pressure during operation of the engine in comparison with the penetration-adsorption type. Thus, the adsorbent of contact-adsorption type is advantageous in that the capacity of the adsorbent to adsorb evaporative fuel as a whole can be substantially equivalent to that of the penetration-adsorption type while reducing the loss of intake pressure to a small value.

This modification employs a pipe line 25 for communication between the lowermost portion of the cylindrical adsorbent 13 and a return portion 21 that is formed at a position lower than the adsorbent 13 of the intake passage 7 and that is between the adsorbent 13 and the engine (a portion of the surge tank 7*b* is used as the return portion 21 in FIG. 2). The pipe line 25 functions as an evaporative fuel return passage.

This modification is also designed such that the cylindrical adsorbent 13 adsorbs and holds evaporative fuel generated in the intake passage during stoppage of the engine. Further, if a part of evaporative fuel is discharged from the adsorbent due to a rise in ambient temperature during stoppage of the engine, discharged evaporative fuel accumulates in the vicinity of the lowermost portion of the adsorbent. In this modification, since the pipe line 25 opens in the vicinity of the lowermost portion of the adsorbent 13, discharged evaporative fuel flows into the pipe line 25, through the pipe line 25, and into the return portion 21 located still lower than the adsorbent 13, and accumulates therein. Hence, the first modification is also designed such that evaporative fuel discharged from the adsorbent 13 does not leak out to the atmosphere from the adsorbent 13 but accumulates in the return portion 21 provided in the intake passage 7 between the adsorbent 13 and the main body of the engine, thus preventing generation of intake leakage emission.

Although the adsorbent 13 shown in FIG. 2 is formed as a cylindrical body that is connected midway through the intake passage 7, it is also possible to form the adsorbent 13 through adhesion of an adsorbent made from silica gel, activated carbon, or the like to the inner wall surface of the intake passage 7 instead of constituting the adsorbent as a cylindrical body separate from the intake passage 7.

Figure 3:
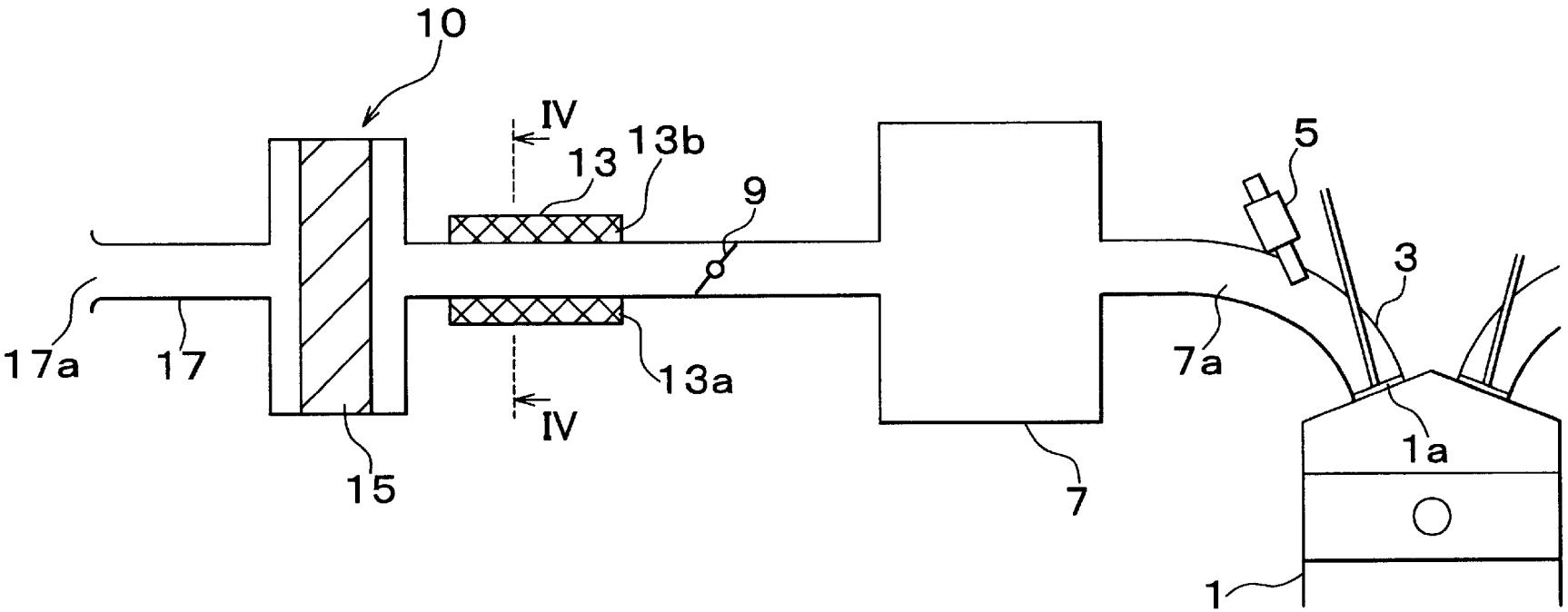
FIG. 3 is an overall structural view of a second modification of the first embodiment.

Next, a second modification of the first embodiment will be described. The aforementioned first embodiment and the first modification thereof are designed such that evaporative fuel discharged from the adsorbent due to a rise in temperature or the like during stoppage of the engine accumulates in the intake passage that is located on the side of the main body of the engine with respect to the adsorbent, thus preventing generation of intake leakage emission. FIG. 3 is a similar view showing the overall structure of the second modification. In FIGS. 2 and 3, like components are denoted by like reference symbols.

As is apparent from FIG. 3, the adsorbent 13 of the second modification is also constructed as a cylindrical body constituting the inner wall surface of the intake passage 7 as is the case with FIG. 2. However, this modification does not employ the pipe line 25 through which evaporative fuel flows to the return portion as shown in FIG. 2.

Figure 4:
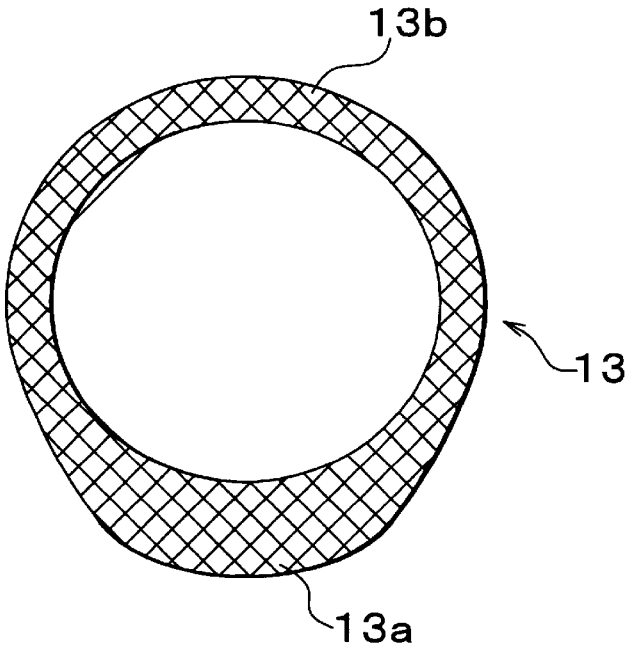
FIG. 4 is a sectional view of an adsorbent taken along a line IV—IV shown in FIG. 3.

FIG. 4 is a sectional view of the adsorbent 13 taken along a line IV—IV in FIG. 3. As shown in FIG. 4, this modification is designed such that the adsorbent 13 is thicker in its lower portion 13*a* than in its upper portion 13*b*. That is, the adsorbent 13 shown in FIG. 4 is designed such that the lower portion 13*a* is larger in adsorbent volume than the upper portion 13*b*. Because the adsorbent volume of the lower portion 13*a* has thus been increased, the lower portion 13*a* of the adsorbent 13 can adsorb more evaporative fuel than the other portions of the adsorbent 13. In other words, the lower portion 13*a* of the adsorbent 13 demonstrates a larger capacity to adsorb evaporative fuel than the other portions of the adsorbent 13. If the intake passage 7 is filled up with evaporative fuel after stoppage of the engine, respective portions of the adsorbent 13 absorb evaporative fuel substantially homogeneously. Hence, if the adsorbent 13 has adsorbed evaporative fuel, the lower portion 13*a* still demonstrates a larger adsorptive capacity than the upper portion 13*b*. If the ambient temperature rises, the adsorptive capacity of the adsorbent decreases. Therefore, the respective portions of the adsorbent discharge such an amount of evaporative fuel as exceeds the adsorptive capacity. In this modification, as shown in FIG. 4, the lower portion 13*a* is different from the upper portion 13*b* in the amount of adsorbable evaporative fuel. Furthermore, since evaporative fuel is heavier in specific weight than air, evaporative fuel discharged from the respective portions of the adsorbent accumulates in the vicinity of the lower portion of the adsorbent. On the other hand, even if evaporative fuel is discharged from a portion other than the lower portion 13*a* due to a decrease in adsorptive capacity resulting from a rise in temperature, the lower portion 13*a* still demonstrates an additional adsorptive capacity, thus making it possible to adsorb more evaporative fuel. Thus, in this case, evaporative fuel discharged from a portion of the adsorbent other than the lower portion 13*a* flows downwards through the adsorbent 13, is absorbed by the lower portion 13*a* again, and is held therein. Hence, this embodiment prevents adsorbed evaporative fuel from being discharged from the adsorbent even if the ambient temperature rises during stoppage of the engine, and thus prevents generation of intake leakage emission.

Figure 5:
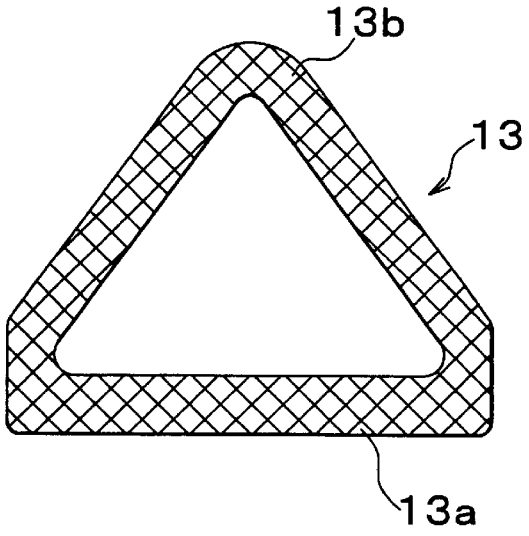
FIG. 5 illustrates another example of a sectional shape of the absorbent shown in FIG. 3.

Although the adsorbent 13 shown in FIGS. 2 and 3 has a cylindrical shape (an annular cross-sectional shape) as an example, it is not indispensable that the adsorbent 13 have a cylindrical shape. That is, the adsorbent 13 may have a triangular cross-sectional shape as shown in FIG. 5. In this case, the lower side of the triangular cross-section is increased in thickness than the other sides thereof, whereby the capacity to adsorb evaporative fuel in the portion corresponding to the lower side of the triangular section can be increased.

Hence, the first embodiment makes it possible to effectively prevent evaporative fuel discharged from the adsorbent from being discharged to the atmosphere due to a rise in temperature during stoppage of the engine in the case where the adsorbent capable of adsorbing evaporative fuel is disposed in the intake passage so as to adsorb evaporative fuel generated in the intake passage during stoppage of the engine.

Figure 7:
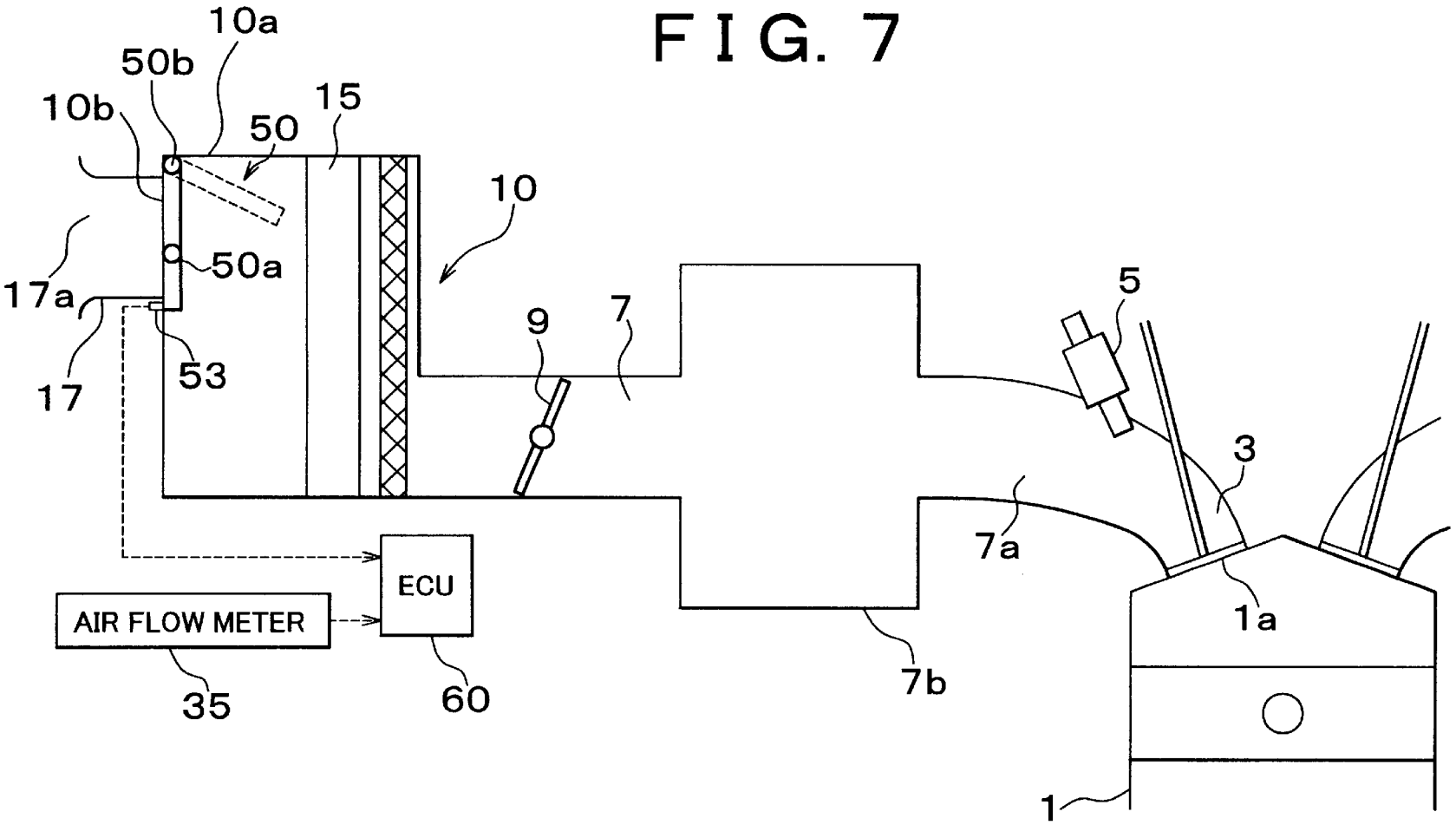
FIG. 7 illustrates the overall structure of an intake system according to a second embodiment of the invention.

Next, a second embodiment of the invention will be described. FIG. 7 illustrates the overall structure of the second embodiment of the invention. This overall structural view includes the same basic components as the drawings that have been referred to in describing the aforementioned first embodiment. Hence, like components are denoted by like reference symbols and only components different from those of the first embodiment are denoted by different reference symbols. FIG. 7 shows an intake valve 1*a* of a cylinder 1 of an internal combustion engine and an intake port 3.

The intake port 3 of each cylinder is connected to a surge tank 7*b* via an intake manifold 7*a*. The surge tank 7*b* is connected to a nozzle 17 via an intake passage 7 and an air cleaner 10. The nozzle 17 serves as an air suction inlet. A throttle valve 9 is disposed in the intake passage 7. FIG. 7 shows a housing 10*a* of the air cleaner 10 and an opening 10*b* in the housing 10*a* for the nozzle 17.

A fuel injection valve 5 injects fuel supplied from a fuel supplying line (not shown) into each intake port during operation of the engine, and introduces fuel into each cylinder together with intake air. An intake flow passage of the air cleaner 10 is provided with a filter element 15 and an adsorbent 13. Alternatively, there may be no adsorbent in this embodiment. During operation of the engine, a part of fuel injected from the fuel injection valve 5 adheres to a wall surface of the intake port 3 while still remaining in its liquid state, thus forming wall-surface adherent fuel. This wall-surface adherent fuel gradually evaporates after stoppage of the engine and becomes evaporative fuel. Further, during stoppage of the engine, fuel held inside the fuel injection valve, although small in amount, may leak out to the intake port. In other words, so-called incomplete oil tightness of the fuel injection valve may occur. The fuel that has leaked out to the intake port due to incomplete oil tightness evaporates during stoppage of the engine and becomes evaporative fuel as in the case of wall-surface adherent fuel. Hence, the intake port 3, the intake manifold 7*a*, the surge tank 7*b*, and the intake passage 7 are filled with evaporative fuel during stoppage of the engine.

If the intake passage 7 is filled with evaporative fuel during stoppage of the engine, the evaporative fuel leaks out from the intake passage 7 through the filter element 15 of the air cleaner 10 to the nozzle 17, and then flows out to the atmosphere from a suction inlet 17*a* of the nozzle 17. This embodiment employs an open-close valve 50 for opening and closing the opening 10 *b* formed in the air cleaner 10 for connection with the nozzle 17 so as to prevent evaporative fuel in the intake passage 7 from being discharged to the atmosphere through the suction inlet 17*a* of the nozzle.

In this embodiment, the open-close valve 50 is constructed by attaching a valve body 50*a* in the shape of a thin flat plate made from a light metal or synthetic resin to the housing 10*a* of the air cleaner 10 at the portion 10*b* for connection with the nozzle 17 by means of a hinge 50*b*. The hinge 50*b* is provided with a spring (not shown), which constantly urges the valve body 50*a* of the open-close valve 50 toward a closure position indicated by a solid line in FIG. 7. As will be described later, this embodiment is designed to set the urging force of the spring such that the valve body of the open-close valve 50 moves away from the housing 10*a*, more specifically, from the portion 10*b* for connection with the nozzle as soon as the flow rate of intake air reaches a predetermined value.

The open-close valve 50 has a greater area than the opening 10*b* formed in the housing 10*a* for connection with the nozzle. When no intake air flows during stoppage of the engine, the open-close valve 50 is pressed against the housing 10*a*, more specifically, against the portion connected to the nozzle due to the weight of the valve body 50*a* itself and the urging force of the spring, and comes into close contact with the wall surface of the housing extending around the portion 10*b* connected to the nozzle. In this embodiment, a planar portion that is in the vicinity of a region around the valve body 50*a* and that is in contact with the wall surface of the housing around the opening 10 *b* functions as a sealing portion on the side of the open-close valve, whereas the wall surface of the housing 10 around the opening 10*b* functions as a sealing portion on the side of the intake passage. These sealing portions are both formed as smooth planes. If these sealing portions come into areal contact with each other, the opening 10*b* is closed and the air cleaner 10 and the intake passage 7 are shut off from the atmosphere.

Hence, if the open-close valve 50 moves to the closure position (indicated by the solid line in FIG. 7) during stoppage of the engine, evaporative fuel generated in the intake passage 7 is prevented from leaking out to the atmosphere. Further, if the engine is started, the open-close valve 50 moves to an open position (indicated by a dotted line in FIG. 7) due to a negative pressure in the intake passage 7 during the starting of the engine, and is held at the open position by the flow of intake air inflowing from the nozzle 17. The flow rate of intake air at which the open-close valve 50 moves away from the wall surface of the housing 10*a*, that is, the flow rate of intake air at which the opening 10*b* for connection is opened is preset as a predetermined flow rate that is lower than the flow rate of intake air during idle driving after completion of the warming-up of the engine, by the urging force of a spring provided at the hinge 50*b* of the valve body 50*a*.

In this embodiment, the open-close valve closes the intake passage through areal contact between the planar sealing portion of the valve body 50*a* and the sealing portion around the, opening 10*b* formed in the housing 10*a* for connection with the nozzle. Thus, even if there is a difference in thermal expansion coefficient between the valve body 50*a* and the housing 10*a*, the valve body 50*a* does not become stuck. Even when foreign matters enter a space between the sealing portion of the valve body 50*a* and the sealing portion on the side of the housing 10*a*, the valve body 50*a* opens smoothly without becoming stuck due to penetration of foreign matters. This embodiment employs an open-close state detecting sensor 53, for example, of a contact switch type. This sensor is disposed close to the opening 10*b* formed in the housing 10*a* for connection with the nozzle.

Next, detection of a malfunction of the open-close valve 50 shown in FIG. 7 will be described. This embodiment employs the open-close state detecting sensor 53, for example, of a contact switch type. This sensor is disposed close to the opening 10*b* formed in the housing 10*a* for connection with the nozzle. The open-close state detecting sensor 53 generates a closure signal (ON signal) when the valve body of the open-close valve 50 closes the opening 10*b* connected to the nozzle, that is, when the sealing portion of the valve body 50*a* is in contact with the sealing portion around the opening 10*b* formed in the housing 10*a* for connection with the nozzle. The open-close state detecting sensor 53 generates an open signal (OFF signal) when the sealing portions are out of contact with each other.

Further, the second embodiment employs an air flow meter 35 that is disposed in the intake passage 7 and that generates a voltage signal corresponding to a flow rate of intake air sucked into the nozzle 17. This embodiment employs an electronic control unit (ECU) 60 for performing engine control. The ECU 60 is constructed of a microcomputer of a known structure. Based on an open-close state of the open-close valve 50 which is detected by the aforementioned open-close state detecting sensor 53 and a flow rate of intake air flowing through the intake passage 7 which is detected by the air flow meter 35, the ECU 60 performs a malfunction sensing operation for determining whether or not the open-close valve 50 suffers a malfunction.

Due to this operation, an output from the air flow meter 35 is input to an input port of the ECU 60 via an A/D converter (not shown) whereas an output from the open-close state detecting sensor 53 is directly input to the input port of the ECU 60. The intake-system evaporative fuel leakage preventing device of the type shown in FIG. 7 may suffer the following four malfunctions:

(1) a failure to close the open-close valve 50 during stoppage of the engine (the sticking of the open-close valve 50 in its open state);

(2) a failure to open the open-close valve 50 during operation of the engine (the sticking of the open-close valve 50 in its closure state);

(3) leakage through the open-close valve 50 (perforation); and (4) a malfunction of the open-close state detecting sensor 53 (the sticking, disconnection, or the like of the open-close state detecting sensor 53).

Hereinafter, methods of sensing a malfunction in this embodiment will be described.

A. (1) a failure to close the open-close valve 50 during stoppage of the engine and (4) a malfunction of the open-close state detecting sensor 53.

A failure to close the open-close valve 50 means a malfunction of the ability to close the intake passage during stoppage of the engine, for example, resulting from the sticking of the open-close valve 50 in its open state. This malfunction can be detected by an output from the open-close state detecting sensor 53 in a state where a main switch of the engine has been turned on immediately before commencement of the engine starting operation.

That is, during stoppage of the engine, the open-close valve 50 ought to be closed as long as it is normal, and the output of the open-close state detecting sensor 53 ought to be ON. Hence, if the output of the open-close state detecting sensor 53 is OFF before the engine is started, it is possible to determine that there is a failure to close the open-close valve 50 or a malfunction of the sensor 53 (the sticking of a contact point in the OFF state or disconnection).

B. (2) a failure to open the open-close valve 50 during operation of the engine and (4) a malfunction of the open-close state detecting sensor 53.

A failure to open the open-close valve 50 means a malfunction in which the open-close valve 50 becomes stuck, for example, during stoppage of the engine and becomes incapable of opening to such an opening that the output of the open-close state detecting sensor 53 is OFF even if operation of the engine is started. This malfunction can be sensed based on an output from the open-close state detecting sensor in a state where intake air flows at a low flow rate, for example, during idle driving after the starting of the engine. That is, this embodiment is designed to set the flow rate of intake air at which the open-close valve 50 opens smaller than a flow rate of intake air corresponding to idle driving after completion of the warning-up of the engine. Therefore, if the engine is operated with intake air flowing at a low flow rate corresponding to idle driving (a flow rate of intake air slightly higher than a set flow rate at which the open-close valve 50 opens) after being started, the open-close valve 50 ought to be open as long as it is normal. Thus, if the output of the open-close state detecting sensor 53 is ON in this state, it is apparent that the open-close valve 50 has become stuck in its closure state, or that the open-close state detecting sensor 53 suffers a malfunction (the sticking of the contact point in the ON state).

On the contrary, if the output of the sensor 53 is OFF when the engine is operated with intake air flowing at a low flow rate corresponding to idle driving, the open-close valve is in normal operation and no leakage has occurred on a large scale unless the sensor 53 suffers a malfunction (the sticking of the contact point in the OFF state or disconnection). Accordingly, if the output of the sensor 53 is OFF in this state and if the output of the open-close state detecting sensor is ON before the engine is started, it is possible to determine that both the open-close valve 50 and the sensor 53 are in normal operation.

C. (3) leakage through the open-close valve 50 (perforation) and (4) a malfunction of the open-close state detecting sensor 53.

This embodiment is designed to detect a case where leakage occurs on a relatively large scale when the open-close valve is closed. If the valve body 50*a* of the open-close valve 50 is bent or perforated, evaporative fuel generated in the intake passage during stoppage of the engine leaks out to the atmosphere through a bent portion or a perforation in the valve body, thus causing evaporation leakage. However, since the pressure of evaporative fuel is actually not very high, evaporation leakage does not raise a problem unless the open-close valve suffers leakage at least on a certain scale. Thus, this embodiment is designed to determine as a malfunction of leakage a case where the open-close valve 50 suffers leakage at least on such a scale that evaporation leakage raises a problem.

Leakage of the valve body of the open-close valve 50 not only causes evaporative fuel to leak out to the atmosphere during stoppage of the engine but also causes intake air to flow into the intake passage while the open-close valve 50 remains closed during operation of the engine. Thus, the open-close valve 50 does not open unless the amount of intake air in the engine increases to a certain extent beyond a set value for opening or closing the open-close valve.

This embodiment is designed to operate the engine with the valve body 50*a* of the open-close valve 50 being preliminarily provided with a hole where minimum possible leakage (maximum allowable leakage) that raises a problem of deterioration in evaporation leakage occurs, and to measure a minimum flow rate A of intake air at which the open-close valve 50 opens after completion of the warming-up of the engine. The flow rate A of intake air is the sum of a flow rate of intake air that is set so as to open the open-close valve 50 and a flow rate of intake air flowing through a leak of the open-close valve. In this embodiment, the sum A of the flow rate of intake air that has been determined in advance as described above and that has been set so as to open the open-close valve 50 and the flow rate of intake air flowing through the leak of the open-close valve is used as a criterion flow rate. If the output of the open-close state detecting sensor 53 is ON (if the open-close valve is closed) when the engine is operated with a flow rate of intake air that is equal to or higher than the criterion flow rate, it is possible to determine that the open-close valve 50 suffers leakage at least on a maximum allowable scale or that the open-close state detecting sensor 53 suffers a malfunction (the sticking of the contact point in its ON state).

Although the foregoing description handles a case where the open-close valve 50 suffers leakage at least on a maximum allowable scale, leakage on a scale smaller than the maximum allowable scale is detected through detection of a failure to open the open-close valve as described above in B.

Figure 8:
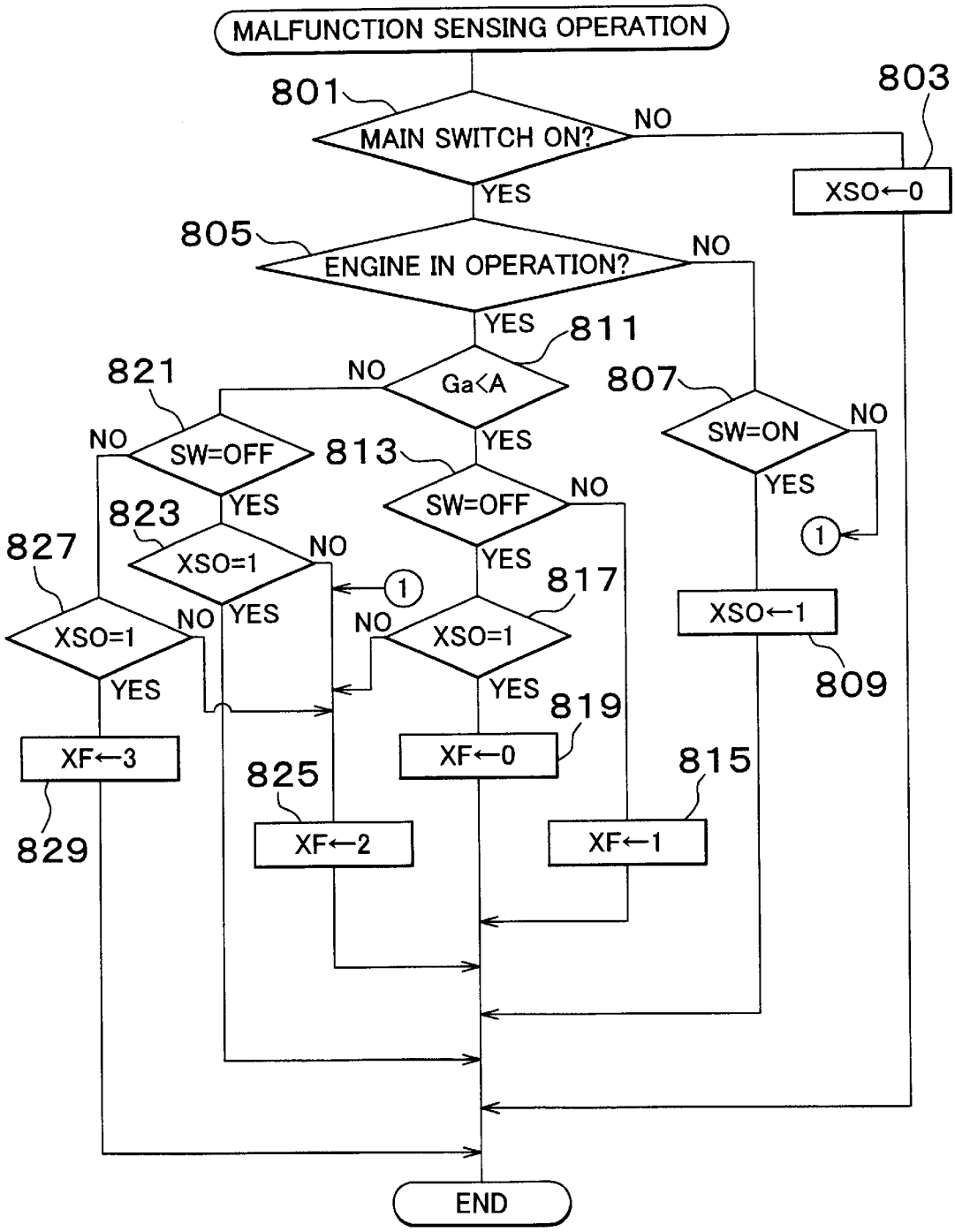
FIG. 8 is a flowchart illustrating an example of a malfunction sensing operation of an evaporative fuel leakage preventing device according to the second embodiment of the invention.

FIG. 8 is a flowchart illustrating an example of a malfunction sensing operation, which is a basic operation of the aforementioned intake-system evaporation leakage preventing device. This operation is performed in accordance with a routine that is executed by the ECU 60 at predetermined intervals.

If the operation is started in FIG. 8, it is determined in step 801 whether or not the main switch is currently OFF. If the main switch is OFF, a flag XSO is set as 0 in step 803. The flag XSO will be described later.

If the main switch of the engine is ON in step 801, it is then determined in step 805 whether or not the engine is currently in operation. If the engine is out of operation, the main switch of the engine is ON and the open-close state detecting sensor 53 functions. Therefore, the process proceeds to step 807 where it is determined whether or not an output SW of the open-close state detecting sensor 53 is currently ON. If the output SW is ON in step 807, the open-close state sensor 53 currently detects that the open-close valve 50 is closed. Thus, the aforementioned flag XSO is set as 1 in step 809. Then, the present process is terminated.

The flag XSO is a flag indicating whether or not the output of the open-close state sensor 53 during stoppage of the engine is normal. The flag XSO=1 indicates that the output of the sensor 53 during stoppage of the engine is normal.

On the other hand, if the sensor SW of the sensor 53 is OFF in step 807, it is indicated that the open-close valve 50 is open despite stoppage of the engine, that the contact point of the sensor 53 is stuck in the OFF state, or that the sensor 53 suffers disconnection. Hence, in this case, while the flag XSO is maintained at 0, the process proceeds to step 825 where a malfunction parameter XF is set as 2. Then, the process is terminated. The parameter XF is a variable indicating a state of malfunction of the intake-system evaporation leakage preventing device. The parameter XF=2 indicates that the open-close valve 50 cannot be closed or that the sensor 53 suffers a malfunction (the sticking of the contact point in the OFF state or disconnection). The processings in step 805, step 807, and step 825 correspond to the detection of a malfunction as described above in A.

Then, if the engine is currently in operation in step 805, the process proceeds to step 811 where it is determined whether or not a current flow rate Ga of intake air in the engine detected by the air flow meter 35 is lower than the criterion value A. It is to be noted herein that the criterion value A is the sum of the flow rate of intake air that is set so as to open the open-close valve 50 and the flow rate of intake air flowing through the maximum allowable leak of the open-close valve, as has been described above as detection of leakage of the open-close valve (detection of a malfunction C).

If Ga<A in step 811, the engine is currently operated with a flow rate of intake air that is lower than a flow rate for detecting whether the open-close valve suffers leakage. Thus, the process proceeds to step 813 so as to determine whether or not the entire intake-system evaporation leakage preventing device is in normal operation. In step 813, it is determined whether or not the output of the open-close state detecting sensor 53 is currently OFF. If the output of the sensor 53 is OFF, the process proceeds to step 817 where it is determined based on the value of the flag XSO whether or not the open-close state detecting sensor 53 demonstrated a normal output during stoppage of the engine. That is, if the flag XSO=1, the output of the open-close state detecting sensor 53 was ON during stoppage of the engine and is currently ON. It is thus considered that the open-close state detecting sensor 53 is in normal operation. Hence, the current OFF output of the open-close state detecting sensor is trustworthy. Therefore, the fact that the output SW is OFF in step 813 indicates that the open-close valve 50 is actually open. That is, since the open-close valve 50 is actually open with intake air flowing at a low flow rate (Ga<A) in this case, there is no failure to open the open-close valve. In other words, the open-close valve 50 is also in normal operation.

That is, since it can be determined in this case that both the sensor 53 and the open-close valve 50 are in normal operation, the process proceeds from step 817 to step 819 where the malfunction parameter XF is set as 0. The malfunction parameter XF=0 means that both the open-close valve 50 and the sensor 53 suffer no malfunction and that the intake-system evaporation leakage preventing device is in normal operation.

On the other hand, if the output SW is ON in step 813, the open-close valve 50 actually remains closed (i.e., a failure to open the open-close valve) or the open-close state detecting sensor 53 suffers a malfunction (the sticking of the contact point). Thus, in this case, the process proceeds to step 815 where the malfunction parameter XF is set as 1. Then, the present process is terminated. The malfunction parameter XF=1 means that the open-close valve 50 cannot be opened during operation of the engine or that the open-close state detecting sensor 53 suffers a malfunction (the sticking of the contact point in the ON state)(see the aforementioned detection of a malfunction B).

Further, if the flag XSO≠1 in step 817, it has already been confirmed that the open-close state detecting sensor 53 suffers a malfunction (the sticking of the contact point in the OFF state or disconnection) when the engine is started (step 807). Thus, the process proceeds to step 825 where the malfunction parameter XF is set as 2. Then, the process is terminated.

Next, if Ga≧A in step 811, it is determined, starting from step 821, whether or not the open-close valve suffers leakage (the aforementioned detection of a malfunction C). In this case, it is determined in step 821 whether or not the output SW of the open-close state detecting sensor 53 is OFF. If the output SW is OFF, the process proceeds to step 823 where it is determined based on the value of the flag XSO whether or not the sensor 53 was in normal operation during stoppage of the engine. If XSO≠1, it has been confirmed that the open-close state detecting sensor 53 had already suffered a malfunction prior to the starting of the engine. Also herein, the process proceeds to step 825 where the malfunction parameter XF is set as 2. Then, the present process is terminated.

Further, if the flag XSO=1 in step 823, it is indicated that the sensor 53 is in normal operation and that the open-close valve 50 is also open. In this case, it is apparent that the open-close valve 50 does not suffer leakage on an unallowable scale. However, since the engine is currently operated with intake air flowing at a high flow rate Ga, the current flow rate of intake air may keep the open-close valve open even if the open-close valve 50 suffers leakage on a relatively small scale or even if it is somewhat difficult to open the open-close valve 50. Accordingly, the result of determination in a state of Ga≧A alone cannot afford a clue for determining that the intake-system evaporation leakage preventing device is in normal operation. Thus, in this case, the malfunction parameter XF is maintained as it is without determining that the intake-system evaporation leakage preventing device is in normal operation. Then, the present process is terminated.

On the other hand, if the output SW of the open-close state detecting sensor 53 is not OFF in step 821, the process proceeds to step 827 where it is confirmed whether or not the sensor 53 suffered a malfunction (whether or not the flag XSO=1) prior to the starting of the engine. If the sensor 53 suffered a malfunction, the process proceeds to step 825 where the malfunction parameter XF is set as 2.

If the flag XSO=1 in step 827, the open-close valve 50 is not open despite the fact that a relatively large volume of intake air is currently flowing through the open-close valve 50. Thus, the open-close valve 50 suffers leakage on a scale exceeding A or the open-close state detecting sensor suffers a malfunction (the sticking of the contact point in the ON state). Thus, in this case, the process proceeds to step 829 where the malfunction parameter XF is set as 3. Then the present operation is terminated. If the malfunction parameter XF=3, it is indicated that the open-close valve 50 suffers leakage on an unallowably large scale or that the open-close state detecting sensor 53 suffers a malfunction (the sticking of the contact point in the ON state).

As described above, this embodiment makes it possible to easily determine whether or not the evaporative fuel leakage preventing device suffers a malfunction and to easily detect the type of the malfunction, based on the flow rate of intake air during operation of the engine which is detected by the air flow meter 35 and on the output of the open-close state detecting sensor 53 at that moment.

The second embodiment makes it possible to prevent the evaporative fuel leakage preventing device from suffering a malfunction and to enhance the reliability of the device.

Furthermore, it becomes possible to easily and reliably determine that the evaporative fuel leakage preventing device suffers a malfunction.

Figure 9:
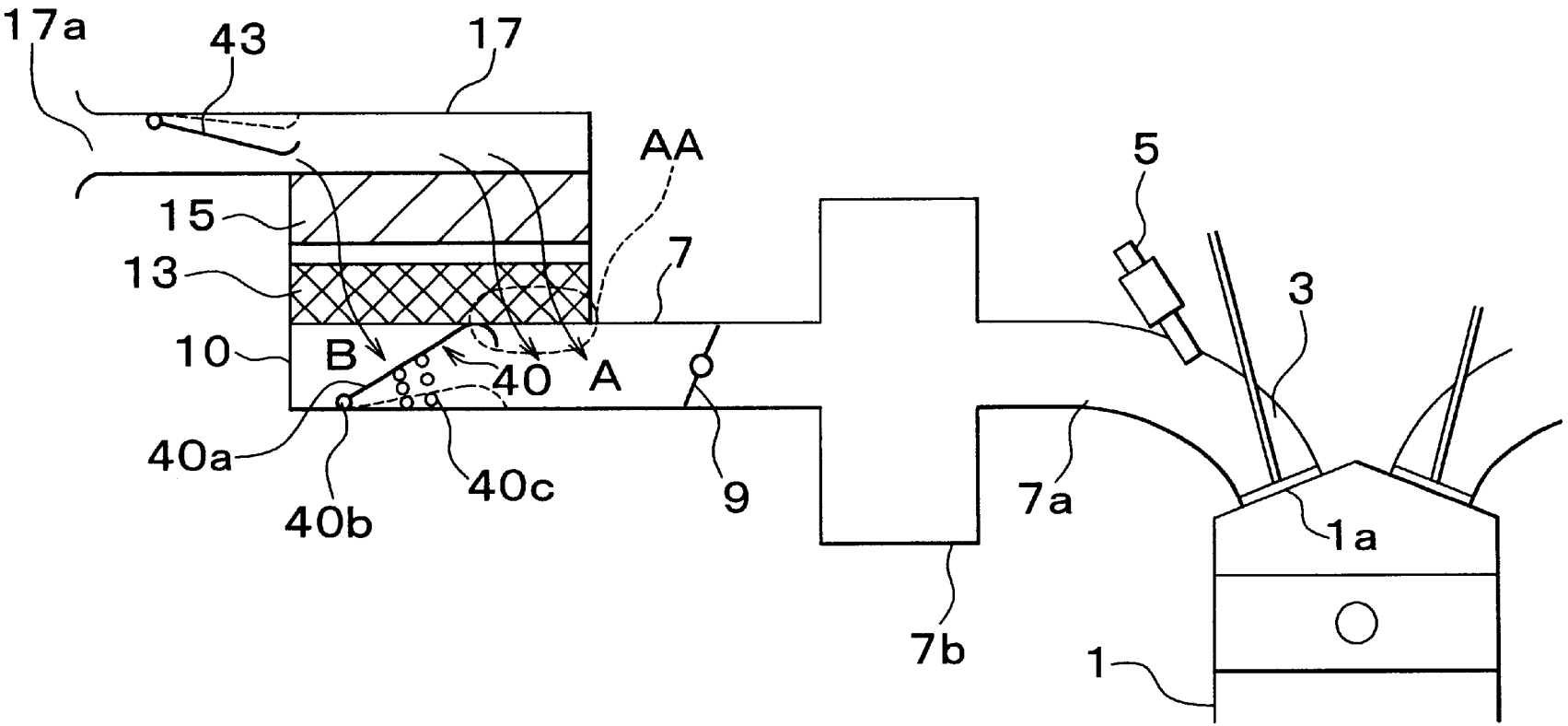
FIG. 9 illustrates the overall structure of an intake system according to a third embodiment of the invention.

Next, a third embodiment of the invention will be described. FIG. 9 illustrates the overall structure of the third embodiment of the invention. This overall structural view includes the same basic components as the drawings that have been referred to in describing the aforementioned first and second embodiments. Hence, like components are denoted by like reference symbols and only components different from those of the first or second embodiment are denoted by different reference symbols.

FIG. 9 shows an intake valve 1*a* of a cylinder 1 of an internal combustion engine and an intake port 3. The intake port 3 of each cylinder is connected to a surge tank 7*b* via an intake manifold 7*a*. The surge tank 7*b* is connected to a nozzle 17 as an air suction inlet via an intake passage 7 and an air cleaner 10. A throttle valve 9 is disposed in the intake passage 7.

A fuel injection valve 5 injects fuel supplied from a fuel supplying line (not shown) into each intake port during operation of an engine, and introduces fuel into each cylinder together with intake air. A filter element 15 is disposed in an intake flow passage of the air cleaner 10. An adsorbent 13 is provided in the filter element 15 on the side of the intake passage 7. The adsorbent 13 is constructed, for example, by filling interstices in a non-woven fabric, a perforated plate, or the like with an adsorptive component such as silica gel, activated carbon, or the like.

During operation of the engine, a part of fuel injected from the fuel injection valve 5 adheres to a wall surface of the intake port 3 while remaining in its liquid state, thus forming wall-surface adherent fuel. This wall-surface adherent fuel gradually evaporates after stoppage of the engine and becomes evaporative fuel. Further, during stoppage of the engine, fuel held inside the fuel injection valve, although small in amount, may leak out to the intake port. In other words, so-called incomplete oil tightness of the fuel injection valve may occur. The fuel that has flown out to the intake port due to incomplete oil tightness evaporates during stoppage of the engine and becomes evaporative fuel as in the case of wall-surface adherent fuel. Hence, the intake port 3, the intake manifold 7*a*, the surge tank 7*b*, and the intake passage 7 are filled with evaporative fuel during stoppage of the engine.

If the intake passage 7 is filled with evaporative fuel during stoppage of the engine, the evaporative fuel leaks out from the intake passage 7 through the filter element of the air cleaner 10 to the nozzle 17, and then flows out to the atmosphere from a suction inlet 17*a* of the nozzle 17. In the third embodiment, an adsorbent 13 capable of adsorbing evaporative fuel is disposed in the air cleaner 10 so as to prevent evaporative fuel in the intake passage 7 from being discharged to the atmosphere through the suction inlet 17*a* of the nozzle. Due to disposition of the adsorbent 13, evaporative fuel filling up the intake passage 7 is adsorbed and held by the adsorbent when flowing through the adsorbent 13, and thus is prevented from being discharged to the atmosphere from the suction inlet 17*a* of the nozzle 17 during stoppage of the engine.

If the engine is then operated, intake air sucked from the suction inlet 17*a* of the nozzle is sucked into the engine from the intake passage 7 through the adsorbent 13 and the filter 15 of the air cleaner 10. Hence, evaporative fuel adsorbed by the adsorbent 13 is desorbed (purging is carried out) by intake air flowing through the adsorbent 13. The evaporative fuel thus desorbed is sucked into the engine together with intake air. This prevents the adsorbent 13 from becoming saturated with vapors adsorbed thereby, thus making it possible to adsorb evaporative fuel when the engine is stopped next time.

However, if the engine is operated with intake air flowing at a low flow rate, some portions of the adsorbent 13 may not be purged completely. That is, air sucked into the engine from the nozzle 17 through the intake passage 7 tends to flow through a path with a low flow resistance. For example, according to a structure in which the intake passage 7 is connected from one side of the air cleaner as shown in FIG. 9, intake air flowing from the nozzle through the air cleaner 10 on the side opposite to a portion connected to the intake passage as indicated by an arrow B in FIG. 9 covers a longer flow path than intake air flowing through the air cleaner 10 on the side of the portion connected to the intake passage as indicated by an arrow A in FIG. 9. Thus, the arrangement shown in FIG. 9 makes it easy for intake air to flow through the path indicated by the arrow A, so that a large amount of intake air flows through the adsorbent 13 on the side of the portion connected to the intake passage (the portion indicated by AA in FIG. 9). If a drift portion (the portion indicated by AA in FIG. 9) through which intake air is more likely to flow as compared with the other portions is thus generated in the adsorbent 13, no serious problem is caused as long as the amount of intake air in the engine is great. However, if the engine is operated with intake air flowing at a low flow rate, most of the intake air flows through the drift portion in the adsorbent, creating a state where almost no intake air flows through the other portions. For example, if the engine is operated with intake air flowing at a low flow rate, the flow of air indicated by the arrow B hardly occurs in the adsorbent 13 in the portion opposite to the portion connected to the intake passage. Hence, evaporative fuel adsorbed by the adsorbent 13 remains in this portion without being desorbed by the adsorbent 13 as long as the engine is operated with intake air flowing at a low flow rate. Accordingly, in such a case where the engine is stopped after being operated with intake air flowing at a low flow rate, the aforementioned portion adsorbs evaporative fuel generated in the intake passage without desorbing the last-adsorbed evaporative fuel. The adsorbent in the aforementioned portion is saturated with evaporative fuel during stoppage of the engine. This leads to a case where it is no longer possible to adsorb evaporative fuel.

If the adsorbent is thus saturated in the portions other than the drift portion, the following problem is caused. That is, evaporative fuel in the intake passage 7 flows through the saturated portions without being adsorbed, and is discharged to the atmosphere from the suction inlet 17*a* of the nozzle 17. The third embodiment solves this problem by providing adsorption adjustment means that mainly causes the aforementioned drift portion AA of the adsorbent 13 to absorb evaporative fuel generated in the intake passage 7 during stoppage of the engine.

As described above, a relatively large amount of intake air flows through the drift portion AA of the adsorbent 13 even when the engine is operated with intake air flowing at a low flow rate. Hence, although the drift portion of the adsorbent 13 has adsorbed a relatively large amount of evaporative fuel, the evaporative fuel can be desorbed efficiently when the engine is operated with intake air flowing at a low flow rate. Thus, by causing the drift portion of the adsorbent 13 to adsorb more evaporative fuel than the other portions thereof, it becomes possible to purge the adsorbent 13 efficiently even when the engine is operated with intake air flowing at a low flow rate. Consequently, the adsorbent 13 is prevented from being saturated with evaporative fuel.

Next, the adsorption adjustment means of this embodiment will be described. This embodiment employs a movable vane 40 shown in FIG. 9 as the adsorption adjustment means. The movable vane 40 is constructed by attaching a thin plate 40*a* made from a light metal or synthetic resin to a housing of the air cleaner 10 by means of a hinge 40*b*. When there is no flow of intake air during stoppage of the engine, the movable vane 40 moves toward a position indicated by a solid line in FIG. 9 by being urged by a small urging force of a spring 40*c*, thus shutting off the adsorbent 13 in the portions other than the drift portion AA from the intake passage 7. In this state, since the movable vane 40 forcefully causes vapors generated in the intake passage 7 to flow through the drift portion AA, evaporative fuel is mainly adsorbed by the drift portion of the adsorbent 13. Thereby, most of the evaporative fuel generated in the intake passage 7 during stoppage of the engine is adsorbed by the drift portion AA of the adsorbent.

If the engine is started in this state and operated with intake air flowing at a low flow rate in a state of low load and low speed, intake air mainly flows through the path that has a low flow resistance and that is indicated by the arrow A, and flows into the intake passage 7 through the drift portion AA of the adsorbent 13 as described above. Thus, a relatively large amount of intake air flows through the drift portion AA even if the engine is operated with intake air flowing at a low flow rate. As a result, evaporative fuel adsorbed by the drift portion AA is desorbed from the adsorbent and sucked into the engine together with intake air.

If the amount of intake air in the engine increases due to an increase in load and rotational speed, the movable vane 40 moves toward a position indicated by a dotted line in FIG. 9 by being pushed by the flow of intake air flowing through the air cleaner 10. Thereby, intake air also flows through the adsorbent in the portions other than the drift portion AA. Also, the adsorbent 13 is desorbed of a small amount of evaporative fuel adsorbed by the adsorbent 13 in the portions other than the drift portion. Consequently, the intake resistance is prevented from increasing due to the movable vane 40. The urging force of the spring 40*c* is set such that the movable vane 40 moves to the position indicated by the dotted line in FIG. 9 (to the open position) in response to a certain increase in the amount of intake air.

Further, it is also appropriate that a vane 43 similar to the movable vane 40 be provided in the nozzle 17, that the weight of the vane 43 (or the urging force of the spring) be set in such a manner as to move the vane 43 to the position indicated by the solid line in FIG. 9 when the amount of intake air is small, and that the flow of intake air be more actively introduced into the drift portion AA of the adsorbent 13 when the engine is operated with intake air flowing at a low flow rate. If the amount of intake air increases, the movable vane 43 of the nozzle 17 moves to the position indicated by the dotted line in FIG. 9 by being pushed by the flow of intake air. Thus, the intake resistance is prevented from increasing in response to an increase in the amount of intake air.

Detailed location, size, and so on of the drift portion AA of the adsorbent 13 differ depending on the structure, arrangement, and so on of the intake system. It is preferable to determine details of the drift portion AA, the weight of the movable vane 40 (and the weight of the movable vane 43 when it is used), the urging force of the spring, and so on by conducting experiments using the actual intake system fitted with an adsorbent.

Further, as in the foregoing description, this embodiment is designed such that the amount of adsorption of evaporative fuel in the adsorbent 13 in the portions other than the drift portion AA is smaller than the amount of adsorption of evaporative fuel in the drift portion AA. Hence, if the drift portion AA as specified above is designed to carry (be filled with) more adsorptive components such as silica gel, activated carbon, and so on than the other portions of the adsorbent so as to increase the capacity to adsorb evaporative fuel in the drift portion AA (or if the amount of adsorptive components carried by the portions other than the drift portion AA is reduced in comparison with the amount of adsorptive components carried by the drift portion AA), the amount of adsorptive components in the entire adsorbent can be reduced.

As described above, this embodiment employs the movable vane 40 as the adsorption adjustment means for adsorbing evaporative fuel in the drift portion AA of the adsorbent 13 in a concentrated manner during stoppage of the engine, whereby the adsorbent 13 can be purged of evaporative fuel efficiently even when the engine is operated with intake air flowing at a low flow rate.

Next, a modification of the third embodiment will be described. The aforementioned third embodiment employs the movable vane 40 as the adsorption adjustment means so as to introduce evaporative fuel generated during stoppage of the engine into the drift portion AA of the adsorbent 13. On the other hand, this modification is different from the third embodiment in that evaporative fuel is introduced into the drift portion without employing the movable vane 40.

Figure 10:
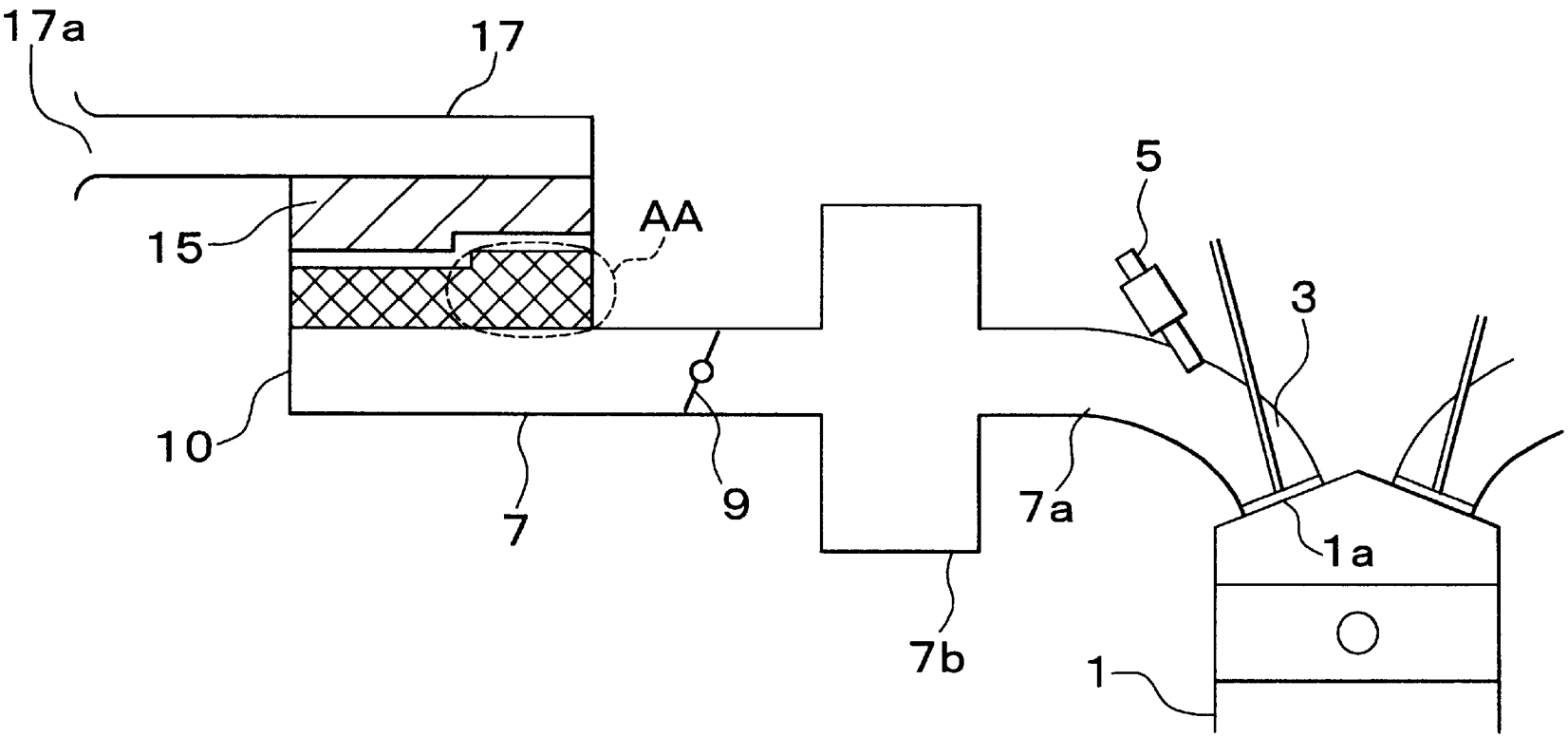
FIG. 10 is an overall structural view of an intake system for illustration of a modification of the third embodiment.

FIG. 10 is a view that is similar to FIG. 9 and that shows the overall structure of the modified third embodiment. In FIGS. 9 and 10, like components are denoted by like reference symbols. In the modified third embodiment shown in FIG. 10, the portion of the filter element 15 corresponding to the drift portion of the adsorbent is reduced for example in thickness as compared with the other portions of the filter element 15 so as to achieve a reduced intake resistance. On the other hand, the drift portion AA of the adsorbent 13 carries more adsorptive components than the other portions of the adsorbent 13, and the drift portion demonstrates a larger capacity to adsorb evaporative fuel than the other portions. Further, intake resistances of the adsorbent 13 and the filter element 15 are set such that the sum of intake resistances of the adsorbent 13 and the filter element 15 becomes smaller in the drift portion AA than in the other portions.

Because the sum of intake resistances in the drift portion AA has thus been made smaller than the sum of intake resistances in the other portions, this embodiment ensures that evaporative fuel generated in the intake passage 7 during stoppage of the engine will mainly flow through the drift portion AA with a reduced resistance in the course of leakage to the nozzle 17. Thus, most of the evaporative fuel is adsorbed by the drift portion AA of the adsorbent 13. Also, since the drift portion AA is further reduced in intake resistance as compared with the third embodiment, a sufficient amount of intake air flows through the drift portion AA of the adsorbent 13 even when the engine is operated with intake air flowing at a low flow rate, so that evaporative fuel adsorbed by the drift portion AA is desorbed. That is, this modification is designed to set the intake resistances of the adsorbent 13 and the filter element 15 in the drift portion AA smaller than those in the other portions, thus substantially achieving the same effect as in the case where the movable vane 40 of the third embodiment is provided.

It goes without saying that this modification is also able to further promote adsorption of evaporative fuel in the drift portion AA if the movable vane 40 as employed in the third embodiment is also provided.

The third embodiment is designed such that the drift portion of the adsorbent, which is easy for intake air to flow through, mainly adsorbs evaporative fuel generated during stoppage of the engine, and thus makes it possible to efficiently purge the adsorbent of evaporative fuel adsorbed thereby without increasing the adsorptive capacity of the entire adsorbent even when the engine is operated with intake air flowing at a low flow rate. Thus, the adsorbent is prevented from being saturated with evaporative fuel even when the engine is operated with intake air flowing at a low flow rate over a long period of time.

Next, in a fourth embodiment of the invention, an evaporative fuel leakage preventing device for an internal combustion engine which can prevent heavy components of fuel from accumulating in an adsorbent and which can desorb evaporative fuel adsorbed by the adsorbent within a short period of engine operation even if the intake air flowing into the internal combustion engine is at a low temperature will be described.

Figure 11:
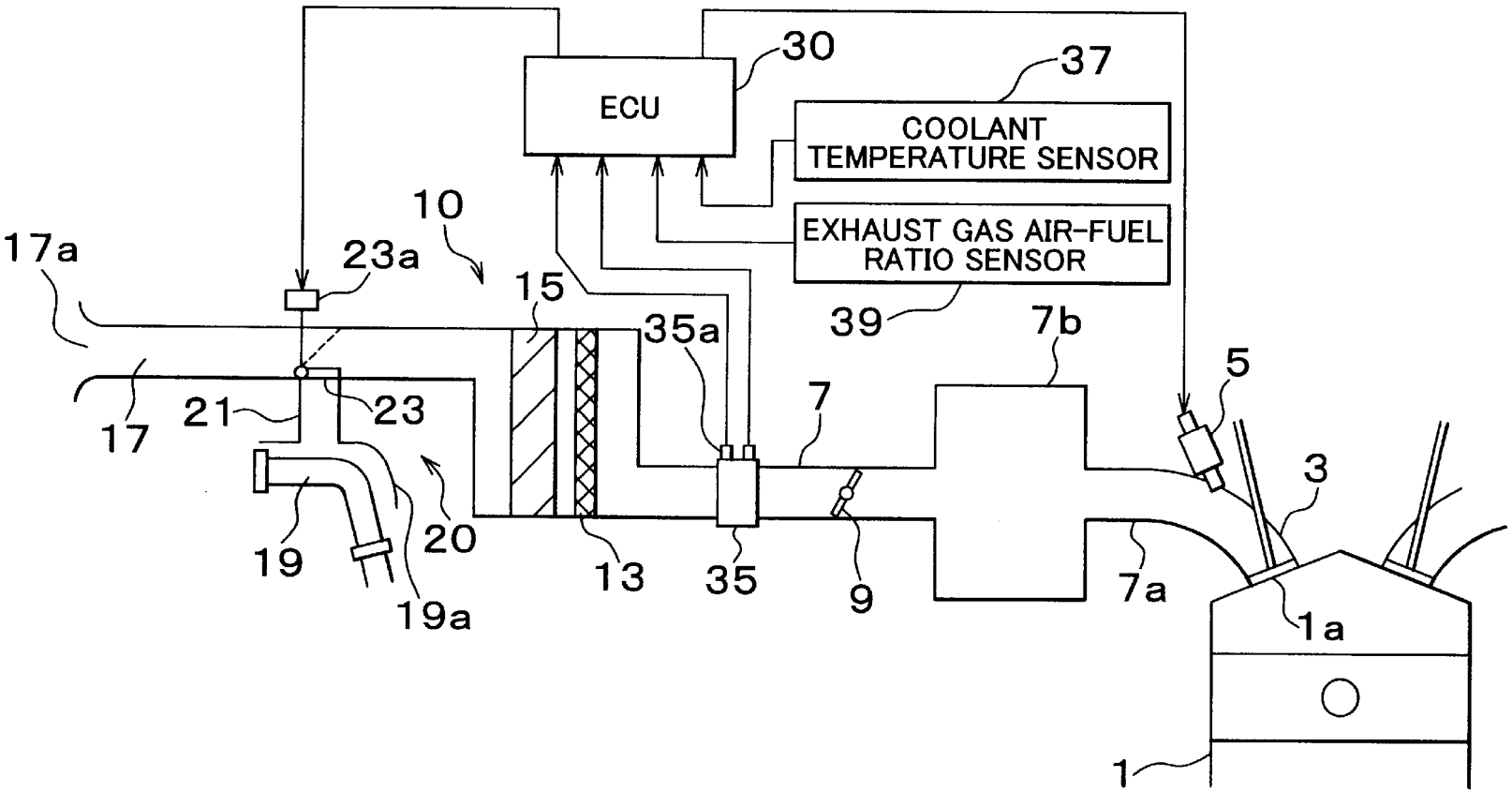
FIG. 11 is a schematic view illustrating the overall structure of an intake system according to a fourth embodiment in the case where the invention is applied to an internal combustion engine for vehicles.

Hereinafter, the fourth embodiment of the invention will be described with reference to the accompanying drawings. FIG. 11 is a schematic view illustrating the overall structure of an intake system of the embodiment in the case where the invention is applied to an internal combustion engine for vehicles. This overall structural view includes the same basic components as the drawings that have been referred to in describing the aforementioned first, second, and third embodiments. Hence, like components are denoted by like reference symbols and only components different from those of the first, second or third embodiment are denoted by different reference symbols. Referring to FIG. 11, an intake port 3 of each cylinder 1 of the internal combustion engine is connected to a surge tank 7*b* via an intake manifold 7*a*. The surge tank 7*b* is connected to a nozzle 17 as an air suction passage via an intake passage 7 and an air cleaner 10. A hot air introduction passage 21, which will be described later, is connected to the nozzle 17. A reference numeral 23 in FIG. 11 denotes a change-over valve provided in the nozzle 17 at a portion connected to the hot air introduction passage 21. The function of the change-over valve 23 will be described later.

Referring to FIG. 11, a fuel injection valve 5 provided in the intake port 3 of each cylinder injects fuel supplied from a fuel supplying line (not shown) during operation of the engine into each intake port and supplies each cylinder with fuel as well as intake air.

Further, an air flow meter 35 for detecting a flow rate of intake air sucked into the engine through the intake port 3 is provided in the intake passage 7 at a position downstream of the air cleaner 10. The air flow meter 35 may be of any appropriate type including a potentiometer-equipped movable vane type, a hot-wire flow meter type, a Karman's vortex street type, and so on. The air flow meter 35 is provided with an intake air temperature sensor 35*a* for correcting a flow rate of intake air by a temperature of intake air. In this embodiment, the intake air temperature sensor 35*a*, which is usually provided as a part of the air flow meter 35, is also employed so as to perform hot air supplying control and malfunction diagnosis of a hot air supplying system, as will be described later in fuller detail. However, it is also possible to provide an intake air temperature sensor that is separate and independent from the air flow meter 35 so as to detect a temperature of intake air.

Further, a throttle valve 9 that assumes an opening amount corresponding to the operation of an accelerator pedal by a driver so as to adjust the amount of air sucked into the engine is provided in the intake passage 7 at a position downstream of the airflow meter 35.

In the fourth embodiment, an adsorbent 13 as well as a filter element 15 are provided inside the air cleaner 10.

During operation of the engine, a part of fuel injected from the fuel injection valve 5 adheres to a wall surface of the intake port 3 while still remaining in its liquid state, thus forming wall-surface adherent fuel. This wall-surface adherent fuel gradually evaporates after stoppage of the engine and becomes evaporative fuel. Further, during stoppage of the engine, fuel held inside the fuel injection valve, although small in amount, may leak out to the intake port from the fuel injection valve. In other words, so-called incomplete oil tightness of the fuel injection valve may occur. The fuel that has leaked out to the intake port due to incomplete oil tightness evaporates during stoppage of the engine and becomes evaporative fuel as in the case of wall-surface adherent fuel. Hence, the intake port 3, the intake manifold 7*a*, the surge tank 7*b*, and the intake passage 7 are filled with evaporative fuel during stoppage of the engine.

If the intake passage 7 is filled with evaporative fuel during stoppage of the engine, the evaporative fuel leaks out from the intake passage 7 through the filter element 15 of the air cleaner 10 to the nozzle 17, and then flows out to the atmosphere from a suction inlet 17*a* of the nozzle 17.

In the fourth embodiment, the above-mentioned adsorbent 13 is disposed in the air cleaner 10 to prevent evaporative fuel in the intake passage 7 from being discharged to the atmosphere through the suction inlet 17*a* of the nozzle, whereby evaporative fuel is prevented from flowing out to the atmosphere. The adsorbent 13 is made from a permeable material such as a filter material on which components capable of adsorbing evaporative fuel (e.g., activated carbon, silica gel, and so on) are carried. As in the case of the filter element 15, the adsorbent 13 is disposed in such a manner as to extend across an air flow passage of the air cleaner 10. Hence, evaporative fuel generated in the intake passage 3 invariably flows through the adsorbent 13 when flowing toward the nozzle 17. Therefore, as long as the adsorptive capacity (i.e., the amount of evaporative fuel that can be adsorbed and held) of the adsorbent 13 is sufficient, namely, as long as the adsorbent 13 is not saturated with adsorbed evaporative fuel, the entire evaporative fuel is adsorbed when flowing through the adsorbent 13 and is held thereby. Thus, evaporative fuel generated in the intake passage 3 during stoppage of the engine is prevented from flowing out to the atmosphere.

Further, if the engine is operated, intake air in the engine flows through the adsorbent 13. Therefore, evaporative fuel adsorbed and held by the adsorbent 13 is desorbed from the adsorbent and sucked into the engine together with intake air. Thereby the adsorbent 13 recovers its adsorptive capacity and becomes capable of adsorbing evaporative fuel again when the engine is stopped next time.

However, if evaporative fuel is desorbed from the adsorbent 13 by intake air during operation of the engine as described above, it may actually be desorbed from the adsorbent insufficiently. In some cases, the evaporative fuel accumulates in the adsorbent 13 to such an extent that the adsorbent becomes saturated. As described above, fuel (e.g., gasoline) of the engine also includes heavy components with a relatively large number of carbon atoms. However, heavy components are less likely to gasify than light components, and are relatively unlikely to be desorbed after being adsorbed by the adsorbent. Hence, under the condition where the engine is stopped repeatedly, for example, after the engine is operated for a short period, while light components are desorbed from the adsorbent during operation of the engine, heavy components cannot be desorbed sufficiently and accumulate gradually in the adsorbent 13. In particular, since these heavy components are less likely to be desorbed if the temperature of intake air (air temperature) is low, the amount of heavy hydrocarbon adsorbed by the adsorbent 13 increases every time the engine is operated and stopped.

If the amount of heavy components adsorbed by the adsorbent 13 increases, the additional amount of evaporative fuel that can be adsorbed by the adsorbent 13 decreases. Therefore, the adsorbent is saturated once it adsorbs just a small amount of evaporative fuel after stoppage of the engine. If the adsorbent 13 is saturated, it can no longer adsorb evaporative fuel. Evaporative fuel generated in the intake passage during stoppage of the engine flows through the adsorbent 13 without being adsorbed, and is discharged to the atmosphere from the suction inlet 17*a* of the nozzle 17.

In the fourth embodiment, a hot air supplying device 20 is provided to prevent heavy components from accumulating in the adsorbent 13 as described above and to reliably desorb heavy components from the adsorbent 13 even during a short period of operation.

As shown in FIG. 11, the hot air supplying device 20 is composed of an insulator cover 19*a* made from a heat insulating material and provided around an exhaust manifold 19 of the engine so as to be spaced therefrom, the hot air introduction passage 21 connected to the cover 19*a*, and the above-mentioned change-over valve 23 disposed in the nozzle 17.

The change-over valve 23 is provided with an actuator of a suitable type such as a vacuum actuator or a solenoid actuator, and closes one of the hot air introduction passage 21 and the nozzle 17 in accordance with an open-close command signal from an electronic control circuit (ECU) 30, which will be described later. That is, if the change-over valve 23 is changed over to a position indicated by a solid line in FIG. 11, the hot air introduction passage 21 is closed and the air cleaner 10 is directly supplied with air at an outside air temperature from the suction inlet 17*a* of the nozzle 17. Further, if the change-over valve 23 is changed to a position indicated by a dotted line in FIG. 11, the nozzle 17 is closed and the hot air introduction passage 21 is opened. Thus, the air cleaner 10 is supplied with air in the vicinity of the exhaust manifold 19 from the hot air introduction passage 21.

In this case, intake air flows through a space between the insulator cover 19*a* and the outer wall of the exhaust manifold 19 and is sucked into the nozzle 17 through the hot air introduction passage 21. However, since the exhaust manifold 19 is at a high temperature during operation of the engine, intake air is heated through contact with the outer wall of the exhaust manifold 19 when flowing through the insulator cover 19*a*, and high-temperature air flows into the air cleaner 10 from the hot air introduction passage 21. If the temperature of intake air flowing through the adsorbent 13 rises, evaporative fuel adsorbed by the adsorbent becomes more likely to be desorbed. Then it becomes possible not only to desorb heavy components of evaporative fuel also within a relatively short period, but also to further reduce the period required for desorption of light components.

Figure 12:
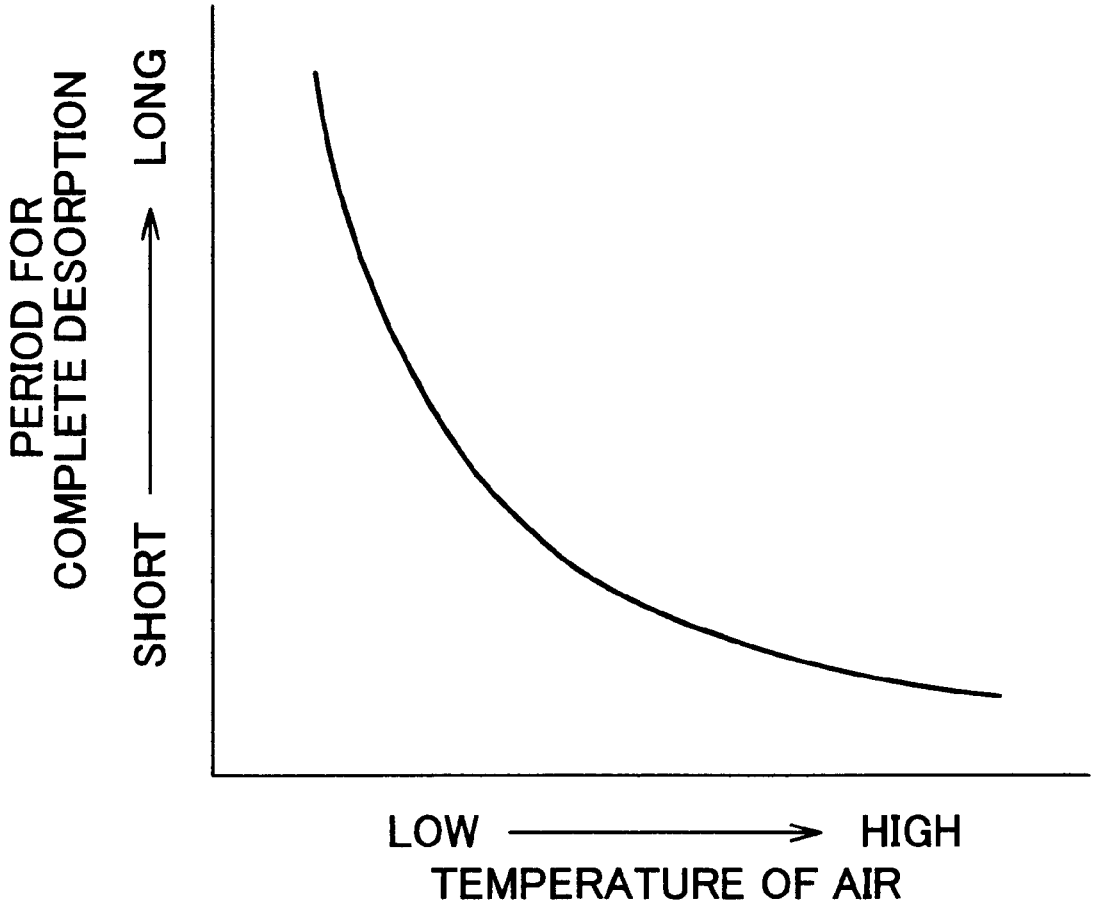
FIG. 12 shows a general relation between a period required for desorption of evaporative fuel from activated carbon and a temperature of purge air.

FIG. 12 is a graph showing a relation between a period required for desorption of the entire evaporative fuel adsorbed by the adsorbent (complete desorption period) and an air temperature. As shown in FIG. 12, the complete desorption period is reduced in proportion to an increase in temperature of air supplied to the adsorbent. In other words, the higher the temperature becomes, the more quickly and the more completely evaporative fuel can be desorbed. Thus, by supplying the adsorbent 13 with intake air heated by exhaust gas from the hot air supplying device 20 during operation of the engine as in the case of the fourth embodiment, it becomes possible to desorb evaporative fuel containing heavy components from the adsorbent 13 within a short period and to completely recuperate the adsorptive capacity of the adsorbent even if the outside air temperature is low.

It has been known to provide a warm-up device that supplies hot air around an exhaust pipe as intake air until completion of the warming-up of an engine when it is started at a low temperature so as to prevent a deterioration in combustion at a low temperature. However, since a low temperature of intake air leads to an enhancement in the volumetric efficiency of intake air and is advantageous from the standpoint of improvements in engine output and fuel consumption, it is generally accepted to stop supplying hot air after completion of the warming-up and directly introduce outside air. On the other hand, this embodiment desires that the adsorbent 13 be supplied with high-temperature intake air for a period sufficient to desorb the entire evaporative fuel from the adsorbent 13. Hence, it is preferable that the adsorbent 13 be supplied with hot air when the temperature of the exhaust pipe has sufficiently risen after completion of the warming-up of the engine. Further, it is preferable that the period for supplying hot air be sufficient, for example, to discharge all the adsorbed evaporative fuel from the adsorbent 13 that is saturated with evaporative fuel. Thus, this embodiment is designed to continue to supply hot air to the adsorbent 13 for a predetermined period after completion of the warming-up of the engine (i.e., after a sufficient rise in temperature of hot air), thus ensuring that high-temperature intake air will be supplied to the adsorbent 13 for a period sufficient for desorption of evaporative fuel.

In the fourth embodiment, the electronic control unit 30 shown in FIG. 11 controls the hot air supplying device so as to desorb evaporative fuel from the adsorbent 13 (purge the adsorbent 13 of evaporative fuel). For example, a microcomputer of a known structure having a RAM, a ROM, a CPU, an input port, and an output port is employed as the electronic control unit 30. In this embodiment, the ECU 30 performs hot air supplying control for purging the adsorbent 13 and later-described malfunction diagnosis of the hot air supplying device as well as basic control such as air-fuel ratio control of the engine.

In order to perform the aforementioned control operations, a signal corresponding to a flow rate of intake air in the engine and a signal corresponding to a temperature of intake air are input to the input port of the ECU 30 from the air flow meter 35 and the intake air temperature sensor 35*a*, respectively, via A/D converters (not shown). In addition, a signal corresponding to a temperature of coolant in the engine and a signal corresponding to an air-fuel ratio of exhaust gas are input to the input port of the ECU 30 from a coolant temperature sensor 37 disposed in a coolant passage of the engine and an exhaust gas air-fuel ratio sensor 39 disposed in an exhaust passage of the engine, respectively, via A/D converters (not shown). Further, the output port of the ECU 30 is connected to the fuel injection valve(s) of the engine via a fuel injection circuit (not shown) so as to control the amount of fuel injection of the engine. In addition, the output port of the ECU 30 is connected to an actuator 23*a* of the change-over valve 23 of the hot air supplying device 20 via a driving circuit (not shown) so as to control open-close operations of the change-over valve 23.

Figure 13:
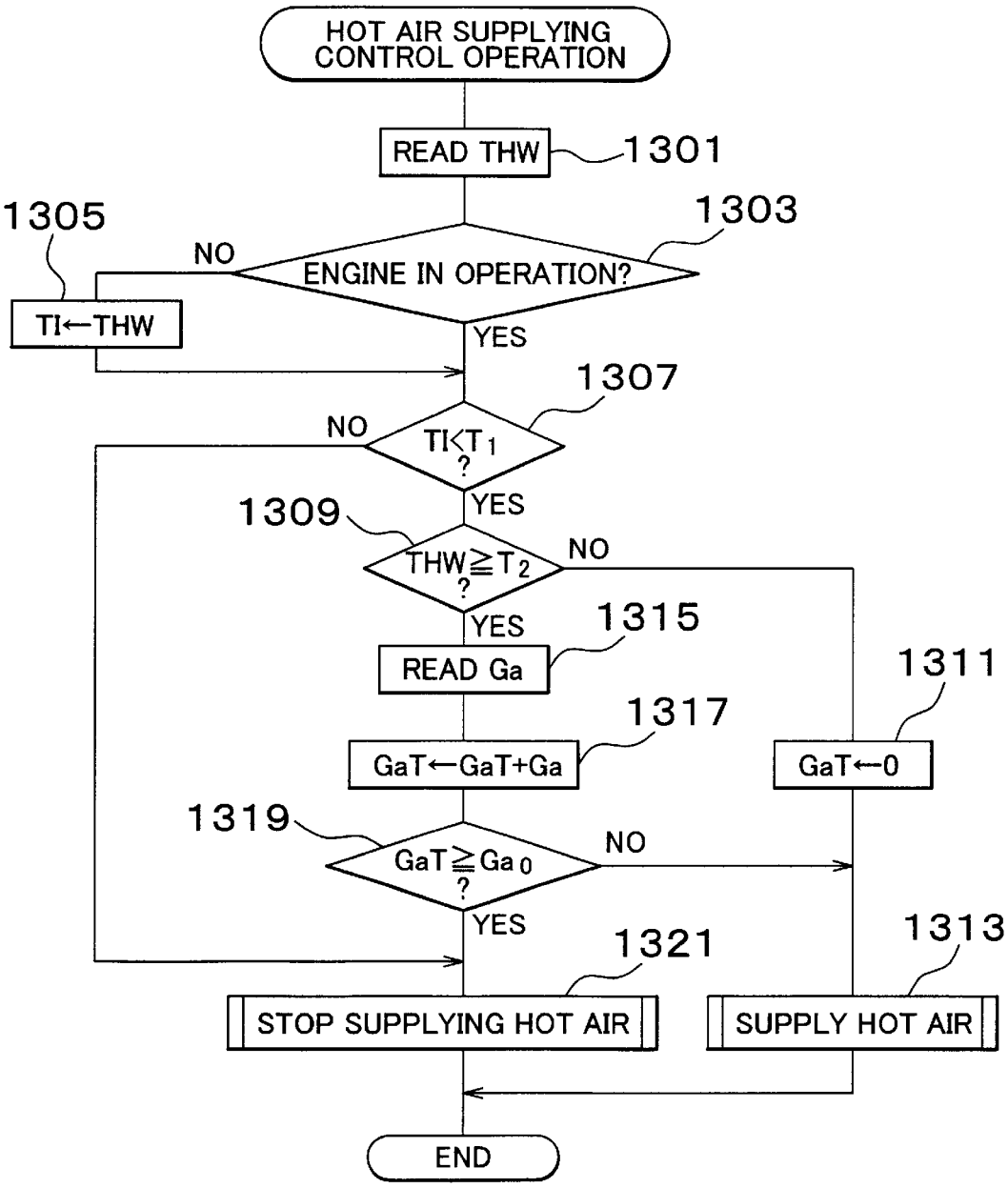
FIG. 13 is a flowchart illustrating a first example of a hot air supplying control operation according to the fourth embodiment of the invention.

FIG. 13 is a flowchart illustrating a first example of a hot air supplying control operation in the fourth embodiment.

This operation is performed in accordance with a routine that is carried out by the ECU 30 at predetermined intervals. In the first example of the operation shown in FIG. 13, the period for supplying hot air to the adsorbent is determined such that the total amount of high-temperature intake air flowing through the adsorbent 13 becomes a predetermined amount. That is, the amount of evaporative fuel desorbed from the adsorbent is generally determined by the total amount of purge air (air flowing through the adsorbent). Accordingly, in order to completely purge the adsorbent 13 of evaporative fuel, it is required that a certain amount or more of high-temperature intake air flow through the adsorbent 13 irrespective of the operational state of the engine. Thus, this embodiment is designed to supply intake air from the hot air introduction passage 21 by opening the change-over valve 23 upon the starting of the engine, but to start calculating an amount of the intake air that has passed through the adsorbent 13, that is, an integrated value of amounts of intake air measured by the air flow meter 35 upon completion of the warming-up, and to continue to supply hot air until the integrated value of amounts of intake air thus calculated reaches a predetermined amount.

In the flowchart shown in FIG. 13, as soon as the operation is started, a temperature THW of engine coolant is read from the coolant temperature sensor 37 in step 1301, and it is determined in step 1303 whether or not the engine is currently in operation. If the engine is currently out of operation, the process proceeds to step 1305 where the temperature THW of coolant thus read is stored as TI. If the engine is currently in operation in step 1303, the process then proceeds to step 1307 where it is determined whether or not the temperature TI of coolant stored in step 1305 is higher than (or equal to) a predetermined value $T_1$. Because the processing in step 1305 is not performed after the starting of the engine, the temperature TI in step 1307 is a temperature of coolant at the time when the engine is started.

If the temperature TI is higher than (or equal to) the predetermined value $T_1$, in step 1307, that is, if the temperature of coolant at the time when the engine is started is high, a short period of time has elapsed since last stoppage of the engine. Therefore, it is considered that the adsorbent 13 has adsorbed just a small amount of evaporative fuel. Further, when the engine is started at a high temperature, that is, with coolant at a high temperature, the temperature of the engine compartment is also high, for example, in the case of a vehicular engine. Thus, the temperature of intake air is somewhat high even though no hot air is supplied. Therefore, in this case, the process proceeds to step 1321 where a hot air supplying stop operation for holding the change-over valve 23 at its closure position (the position indicated by the solid line in FIG. 11) is performed. Then the present process is terminated. In this embodiment, the temperature $T_1$, of coolant in step 1307 is set, for example, as about 70° C.

If $TI<T_1$ in step 1307, that is, if the engine is not started at a high temperature, it is then determined in step 1309 whether or not the warming-up of the engine has been completed. If the current temperature THW of coolant has reached a predetermined temperature $T_2$ ($T_2>T_1$, e.g., $T_2$80° C.), it is determined in step 1309 that the warming-up has been completed. If the warming-up has not been completed in step 1309, an integrated value GaT of amounts of intake air is then set as 0 in step 1311. The process then proceeds to step 1313 where the hot air supplying operation is performed. In the hot air supplying operation, the change-over valve 23 of the hot air supplying device 20 is held at the position indicated by the dotted line in FIG. 11. Thereby, the adsorbent 13 is supplied with intake air from the hot air introduction passage 21. Thus, evaporative fuel containing heavy components is desorbed from the adsorbent 13 due to high-temperature air.

If the temperature THW of coolant reaches the predetermined value $T_2$ and the warming-up of the engine is completed in step 1309, integration of amounts of intake air is then started in step 1315 and step 1317. That is, a current amount Ga of intake air is read from the air flow meter 35 in step 1315, and is added to the integrated value GaT of amounts of intake air in step 1317. The integrated value GaT is constantly cleared in step 1311 until the warming-up of the engine is completed. Further, the present process is performed at predetermined intervals. Hence, the value GaT calculated in step 1317 represents an integrated value of amounts of intake air after completion of the warming-up of the engine, that is, a total amount of the intake air that has passed through the adsorbent 13 after a sufficient rise in temperature of intake air.

After the integrated value GaT is calculated in step 1317, it is then determined in step 1319 whether or not the integrated value GaT thus calculated has reached a predetermined value $Ga_0$. If the integrated value GaT has not reached the predetermined value $Ga_0$ in step 1319, a sufficient amount of high-temperature intake air has not yet been supplied to the adsorbent 13. Therefore, the process proceeds from step 1319 to step 1313, thus continuing to perform the hot air supplying operation. On the other hand, if $GaT \geqq Ga_0$ in step 1319, a sufficient amount of high-temperature intake air has already been supplied to the adsorbent 13, and the adsorbent 13 has been completely purged of evaporative fuel containing heavy components. Thus, in this case, the process proceeds to step 1321 where the hot air supplying operation is stopped. Thereby, the change-over valve 23 is maintained at the position indicated by the solid line in FIG. 11, and low-temperature intake air is supplied to the engine from the suction inlet 17*a* of the nozzle 17. Consequently, improvements in engine output and fuel consumption are achieved.

As described above, since this embodiment is designed to supply hot air to the adsorbent 13 for a predetermined period (the period that is required until the integrated value of amounts of intake air reaches the predetermined value $Ga_0$) after completion of the warming-up, the adsorbent 13 is reliably purged of evaporative fuel regardless of the operational state of the engine after the starting thereof. The aforementioned criterion value $Ga_0$ is set as a sufficient amount of high-temperature intake air, that is, such an amount of high-temperature intake air as to purge the adsorbent 13, which is saturated with heavy components of evaporative fuel, of evaporative fuel completely. However, since the value $Ga_0$ differs depending on the type, capacity, and so on of the adsorbent 13, the value of $Ga_0$ is determined experimentally using an engine that is actually fitted with the adsorbent 13.

Next, a second example of the hot air supplying control operation of the invention will be described. In the aforementioned first example, the criterion value $Ga_0$, which is designed for the integrated value Ga of amounts of intake air after completion of the warming-up and which determines the period for supplying hot air, is a constant value. However, as described with reference to FIG. 12, if the adsorbent 13 is supplied with high-temperature purge air, the period (the amount of air) required for completion of the purging of evaporative fuel increases in proportion to a decrease in temperature of purge air flowing through the adsorbent 13. On the other hand, if hot air is introduced by the hot air supplying device 20 as shown in FIG. 11, the temperature of the hot air that has been heated in the exhaust manifold falls in proportion to a fall in outside air temperature. Thus, since the temperature of purge air flowing through the adsorbent 13 actually falls in proportion to a fall in outside air temperature, it is necessary to increase the amount of air to be supplied to the adsorbent 13 in proportion to a fall in outside air temperature.

In the second example, the criterion value $Ga_0$, which is designed for the integrated value GaT of amounts of intake air after the warming-up and which determines the period for supplying hot air, is changed in accordance with an outside air temperature. That is, the value $Ga_0$ is increased in proportion to a fall in outside air temperature. Thereby, the total amount of purge air supplied to the adsorbent 13 increases in proportion to a fall in outside air temperature. Thus, the adsorbent 13 is purged of evaporative fuel completely.

Figure 14:
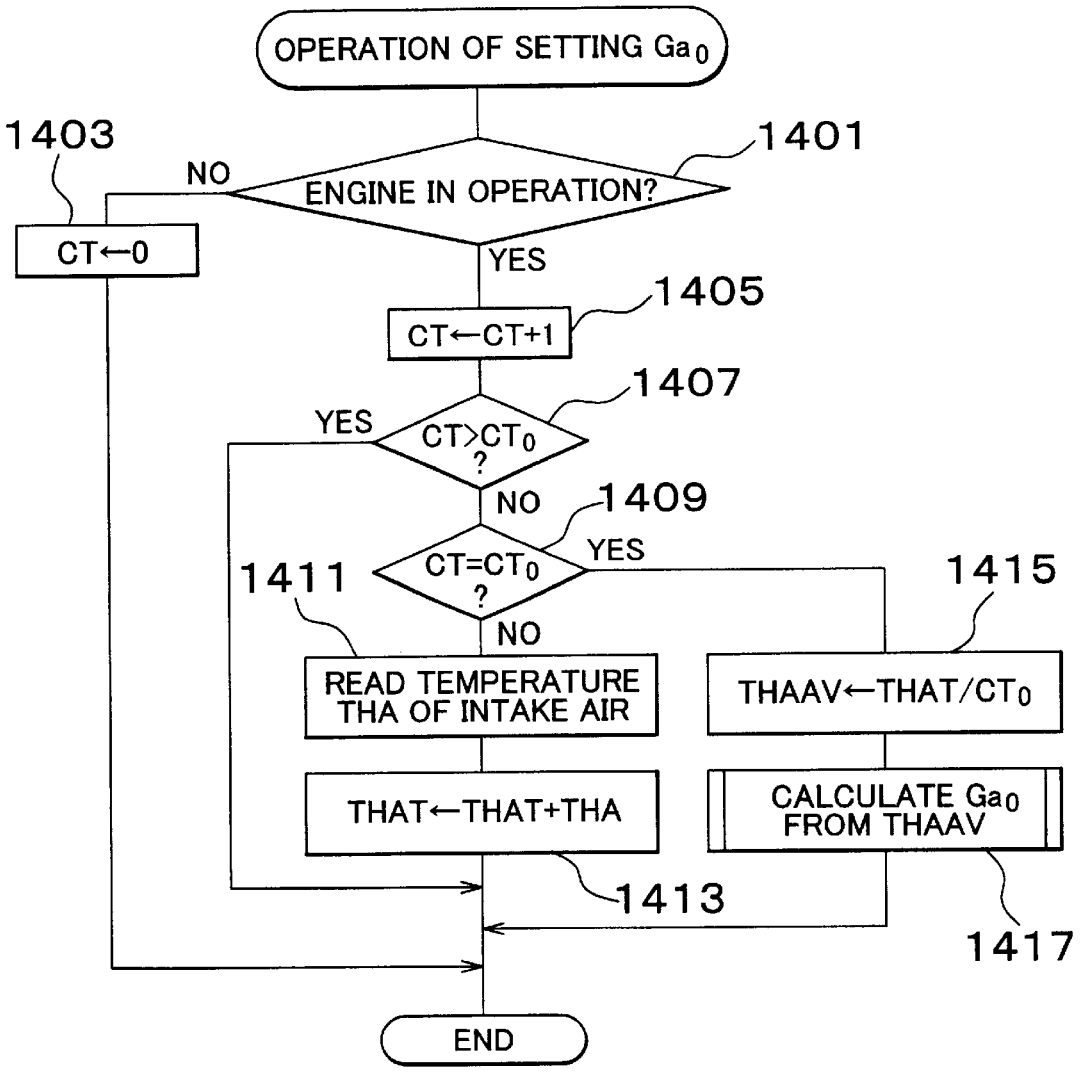
FIG. 14 is a flowchart illustrating a second example of the hot air supplying control operation according to the fourth embodiment of the invention.

FIG. 14 is a flowchart showing an example of an operation of setting the criterion value $Ga_0$. This operation is performed in accordance with a routine that is executed by the ECU 30 at predetermined intervals. In the setting operation shown in FIG. 14, an average THAAV of temperatures THA of intake air which are read by the intake air temperature sensor 35*a* for a predetermined period after the starting of the engine is calculated, and the criterion value $Ga_0$ for the integrated value GaT of amounts of intake air in the operation shown in FIG. 13 is set in accordance with the average temperature THAAV. That is, as soon as the operation is started in FIG. 14 (YES result of step 1401), the value of a counter CT is incremented by 1 in step 1405. Until the value of the counter CT reaches a predetermined value $CT_0$ (step 1409), a temperature THA of intake air is read every time the operation is performed. An integrated value THAT of temperatures of intake air thus read is calculated (step 1411 and step 1413). The value of the counter CT is always cleared in step 1403 before the engine is started. The value CT in step 1407 and step 1409 corresponds to a time that has elapsed after the starting of the engine.

If $CT=CT_0$ in step 1409, that is, if a predetermined time has elapsed after the starting of the engine, a current average THAAV of temperatures of intake air is calculated as $THAAV=THAT/CT_0$ (step 1415), and the criterion value $Ga_0$ is set based on the average THAAV (step 1417).

Figure 15:
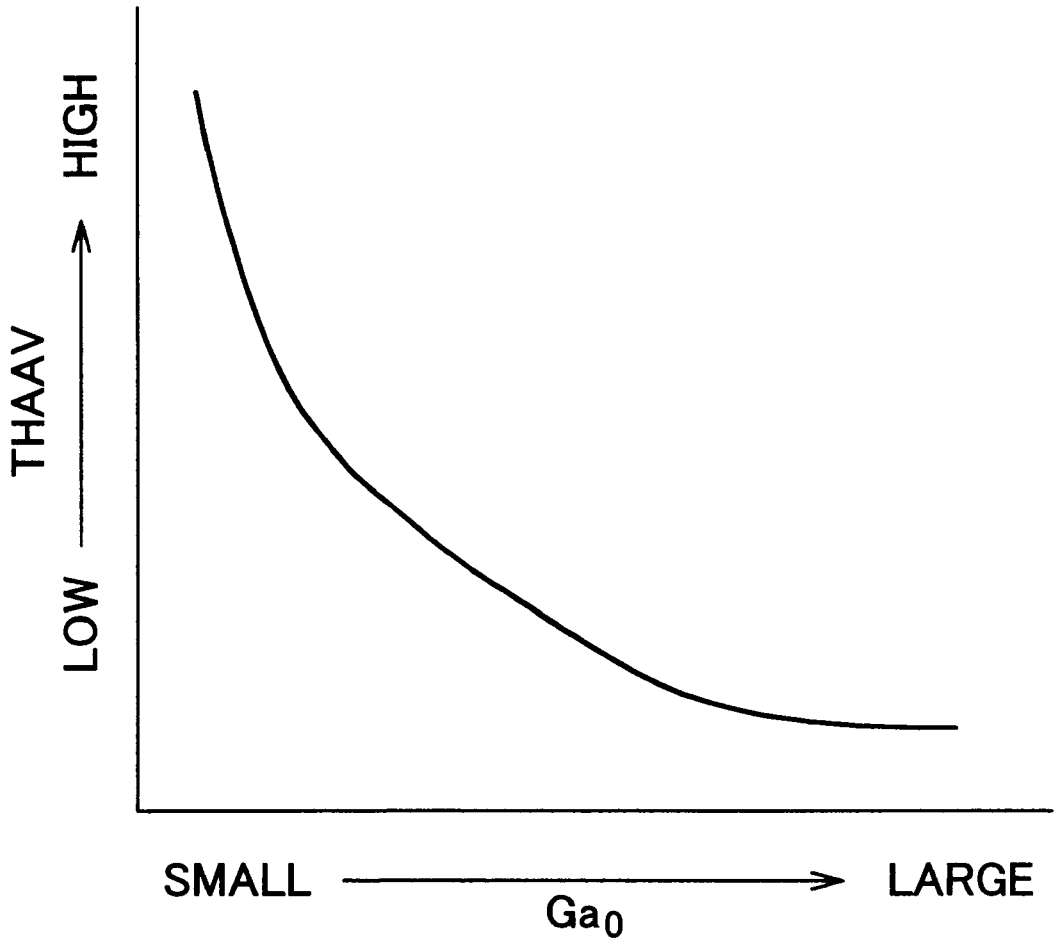
FIG. 15 shows a relation between a criterion value $Ga_0$ set in FIG. 14 and an average temperature THAAV of intake air.

FIG. 15 shows a relation between the criterion value $Ga_0$ set in step 1417 and the average THAAV of temperatures of intake air. As shown in FIG. 15, the criterion value $Ga_0$ is set as a value that is increased in proportion to a fall in the average of temperatures of intake air after the starting of the engine (i.e., outside air temperature). Therefore, in the operation shown in FIG. 13, the period for supplying hot air is increased (the amount of air to be supplied is increased) in proportion to a fall in outside air temperature. In FIG. 14, once the criterion value $Ga_0$ is calculated in step 1417, the present operation is then terminated immediately.

As described above, this embodiment is designed to set the criterion value $Ga_0$ in accordance with an outside air temperature and to increase the period for supplying the adsorbent 13 with hot air (to increase the total amount of air supplied to the adsorbent 13) in proportion to a fall in outside air temperature. Therefore, the adsorbent 13 is reliably purged of evaporative fuel regardless of the outside air temperature.

Next, a third example of the hot air supplying operation of the invention will be described. In the aforementioned first example, the supplying of hot air is started simultaneously with the starting of the engine. However, as described with reference to FIG. 11, the hot air supplying device 20 is designed to heat air by exhaust heat. Thus, the temperature of exhaust gas falls if the hot air supplying device 20 is operated.

On the other hand, during cold start or the like of an engine, especially an engine having an exhaust gas purification catalyst, it is required that the temperature of the exhaust gas purification catalyst rise as quickly as possible and reach an activation temperature of the catalyst. Hence, in the case of such an engine having an exhaust gas purification catalyst, if the supplying of hot air is started upon the starting of the engine, the catalyst is deprived of exhaust heat by hot air. This causes a problem of a delay in rise of the temperature of the catalyst (the warming-up of the catalyst). In view of this problem, this embodiment is designed to refrain from supplying hot air while the engine is being warmed up and to start supplying the adsorbent 13 with hot air upon completion of the warming-up.

Figure 16:
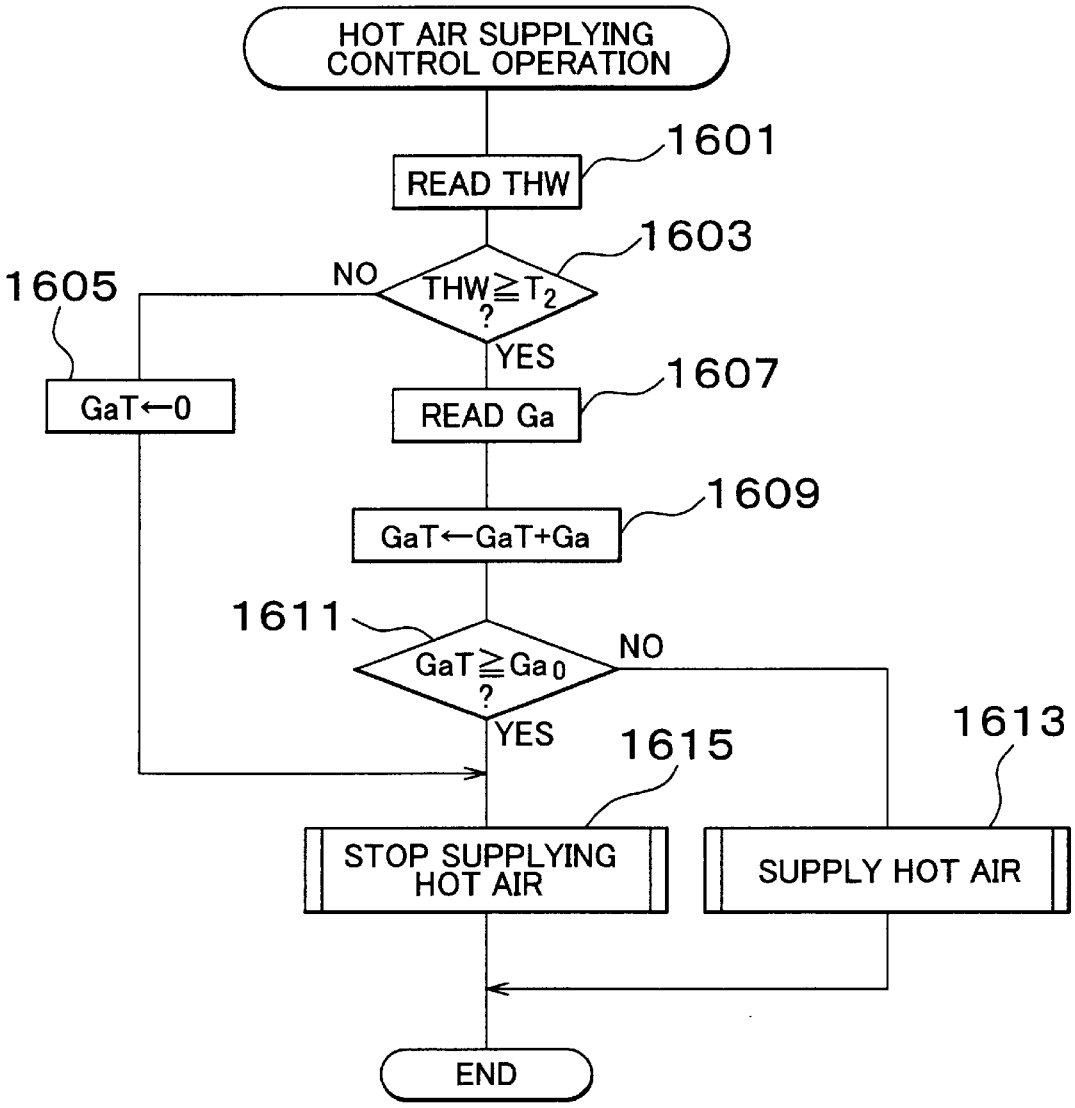
FIG. 16 is a flowchart illustrating a third example of the hot air supplying control operation according to the fourth embodiment of the invention.

FIG. 16 is a flowchart showing the third example of the hot air supplying operation. This operation is performed in accordance with a routine that is executed by the ECU 30 at predetermined intervals. The operation shown in FIG. 16 is designed just to clear the integrated value GaT of amounts of intake air and not to supply hot air (step 1605 and step 1615) until the temperature of coolant reaches a predetermined value T2 after the starting of the engine, that is, until the warming-up of the engine is completed (step 1601 and step 1603). Then, upon completion of the warming-up of the engine, integration of amounts Ga of intake air is started (step 1607 and step 1609), and the supplying of hot air is continued until the integrated value GaT reaches the criterion value $Ga_0$ (step 1611, step 1613, and step 1615). Thus, even if the engine has been started at a low temperature, the supplying of hot air is withheld (i.e., prohibited or delayed) until the warming-up of the engine is completed. Consequently, a delay in completion of the warming-up of the engine (including the catalyst) is prevented.

Next, a fourth example of the hot air supplying control operation of the invention will be described. In this example, the ECU 30 performs feedback control of a fuel injection amount of the engine based on an output of the exhaust gas air-fuel ratio sensor 39 disposed in the exhaust passage of the engine, and performs air-fuel ratio control so as to maintain the air-fuel ratio of the engine at a target air-fuel ratio. In air-fuel ratio control, the ECU 30 calculates a basic fuel injection amount required for maintaining the air-fuel ratio of the engine at the target air-fuel ratio, based on the amount Ga of intake air in the engine detected by the airflow meter 35 and a speed of the engine. Also, the ECU 30 calculates a correction factor (air-fuel ratio correction factor) for the fuel injection amount for correcting an actual air-fuel ratio of exhaust gas to the target air-fuel ratio, based on a difference between the actual air-fuel ratio of exhaust gas detected by the exhaust gas air-fuel ratio sensor 39 and the target air-fuel ratio. The actual fuel injection amount is set as a value obtained by multiplying the aforementioned basic fuel injection amount by the air-fuel ratio correction factor. Due to such air-fuel ratio control, the fuel injection amount of the engine is precisely controlled to such a value as to achieve the target air-fuel ratio even if the characteristic of a component member of the fuel injection system such as the fuel injection valve has been changed because of aging.

In fact, however, upper and lower limit values are generally set for the air-fuel ratio correction factor. Hence, if aging-based changes in the characteristic of the aforementioned fuel injection valve or the like are corrected using the air-fuel ratio correction factor, the air-fuel ratio correction factor may become close to the upper limit value or the lower limit value. In other words, the correction range extending from the air-fuel ratio correction factor to the upper or lower limit value may be narrowed. Thus, the fourth example is designed to correct an aging-based difference between the actual air-fuel ratio and the target air-fuel ratio using a learning correction factor in addition to the air-fuel ratio correction factor. In general, the learning correction factor is calculated, for example, based on a deviation from a reference value (e.g., 1.0) of the air-fuel ratio correction factor during air-fuel ratio control. Further, an operation of calculating the learning correction factor (base air-fuel ratio calculating operation) is usually performed upon commencement of air-fuel ratio control after the starting of the engine.

However, this base air-fuel ratio calculating operation is intended to detect a discrepancy between a command value for the fuel injection amount and an actual amount of fuel injected from the fuel injection valve, and so on. Hence, if the engine is supplied with fuel by a means other than fuel injection during the base A/F calculating operation, there arises a problem of lack of precision in calculating the learning correction factor.

On the other hand, if the adsorbent 13 is supplied with high-temperature intake air after the supplying of hot air has been started, a relatively large amount of evaporative fuel is obtained from the adsorbent 13 and is supplied to the engine together with intake air. Therefore, if hot air is supplied during the base air-fuel ratio calculating operation, evaporative fuel supplied to the engine together with intake air causes a problem of deterioration in reliability of the learning correction factor that has been calculated. In view of this problem, the fourth example is designed to refrain from supplying hot air until completion of the base air-fuel ratio calculating operation that is performed at the early stage of air-fuel ratio control, and to start supplying hot air upon termination of the base air-fuel ratio calculating operation. This prevents the learning correction factor from producing an error due to the evaporative fuel desorbed from the adsorbent 13.

Figure 17:
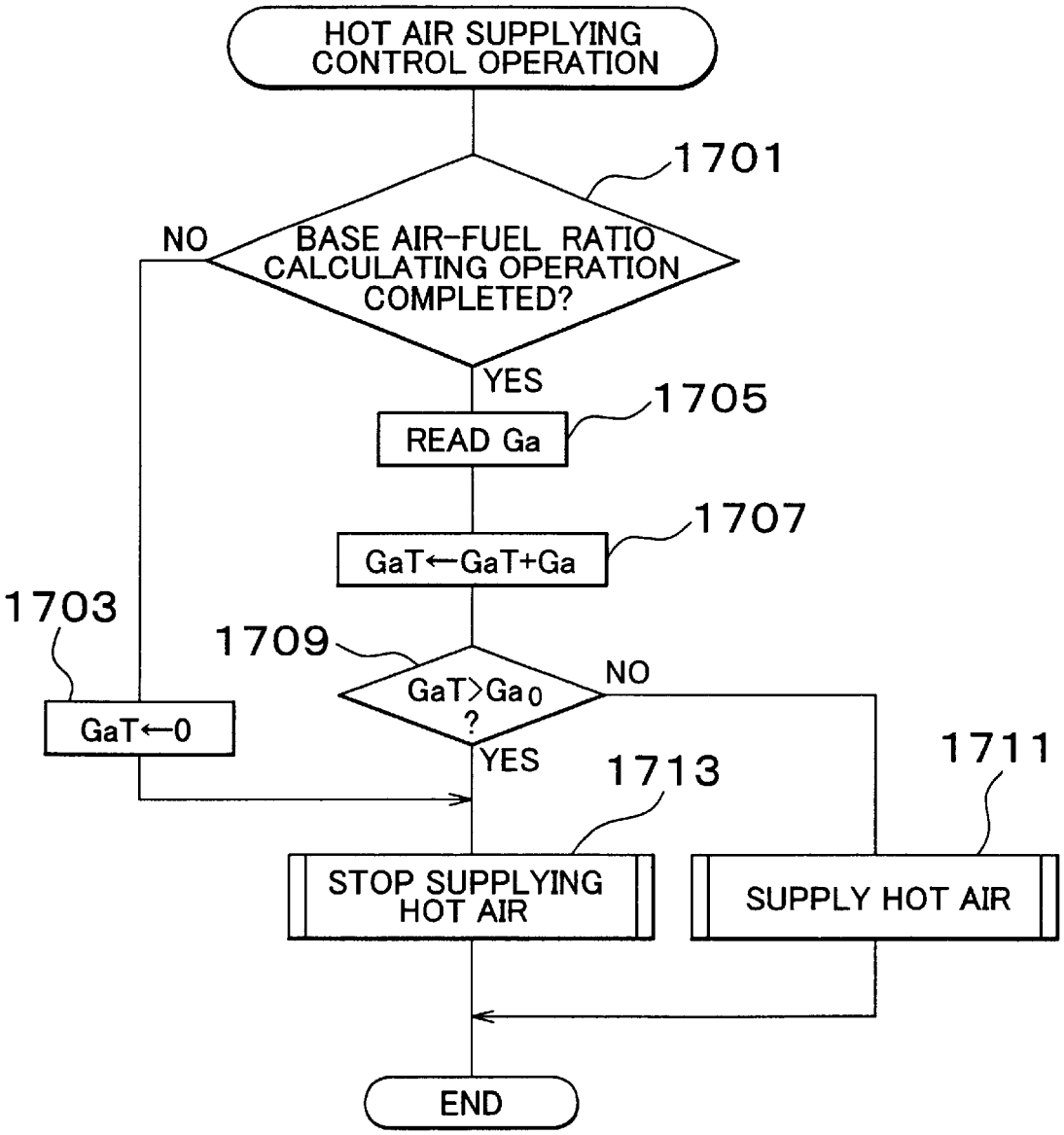
FIG. 17 is a flowchart illustrating a fourth example of the hot air supplying control operation according to the fourth embodiment of the invention.

FIG. 17 is a flowchart illustrating the fourth example of the hot air supplying control operation. This operation is performed in accordance with a routine that is executed by the ECU 30 at predetermined intervals. The operation shown in FIG. 17 is substantially identical with the operation shown in FIG. 16 except that it is determined in step 1701 whether or not the base air-fuel ratio calculating operation has been completed and that calculation of the integrated value GaT of amounts of intake air and the supplying of hot air are started upon completion of the base air-fuel ratio calculating operation. The processings from step 1703 to step 1713 are identical with the processings from step 1605 to step 1615 respectively, and thus detailed description thereof is omitted herein.

Next, a fifth example of the hot air supplying control operation of the invention will be described. The fourth embodiment shown in FIG. 13 is designed to calculate the integrated value (GaT) of amounts of intake air through direct integration of amounts (Ga) of air sucked into the engine, and to supply the adsorbent with hot air until the integrated value reaches the predetermined criterion value ($Ga_0$). However, the temperature of hot air supplied to the adsorbent changes depending on the amount of intake air in the engine. For example, if the engine assumes an operational state where intake air flows at a high flow rate, the temperature of exhaust gas is also high. However, since the period of contact between introduced hot air and the exhaust manifold is reduced, the temperature of hot air is lower as compared with the case where the flow rate of intake air in the engine is low. Hence, even if the adsorbent is supplied with an equal amount of hot air, the effect of desorbing evaporative fuel from the adsorbent in the case where the flow rate of intake air in the engine is high is diminished as compared with the case where the flow rate of intake air in the engine is low.

As is the case with the first example, the fifth example is designed to determine the period of supplying hot air based on the integrated value of amounts of intake air in the engine. However, in consideration of the aforementioned difference in temperature of hot air, the fifth example is designed to perform correction such that the integrated value of amounts of air in the case where the flow rate of intake air in the engine is high becomes smaller than the integrated value of amounts of air in the case where the flow rate of intake air in the engine is low. That is, this example is designed to integrate values obtained by multiplying flow rates of intake air in the engine by a correction factor, instead of directly integrating flow rates of intake air in the engine. Further, this correction factor is set as a value that decreases in proportion to an increase in flow rate of intake air in the engine, that is, in proportion to a fall in temperature of hot air. Thus, the integrated value is corrected in accordance with changes in temperature of hot air resulting from the flow rate of intake air in the engine. Therefore, it becomes possible to reliably desorb evaporative fuel from the adsorbent regardless of the operational state of the engine.

Figure 18:
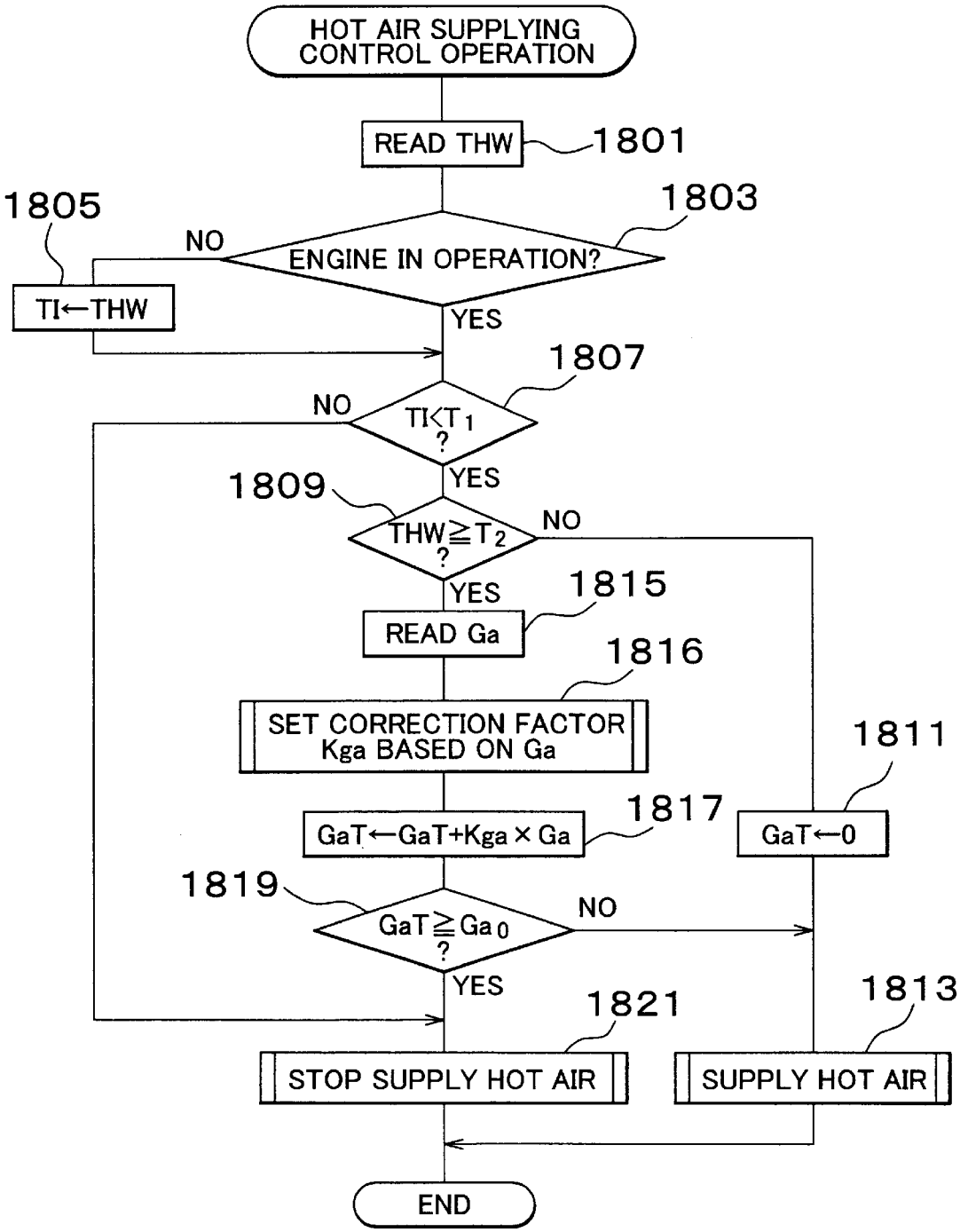
FIG. 18 is a flowchart illustrating a fifth example of the hot air supplying control operation according to the fourth embodiment of the invention.

FIG. 18 is a flowchart illustrating the fifth example of the hot air supplying control operation of this embodiment. This operation is performed in accordance with a routine that is executed by the ECU 30 at predetermined intervals. The operation shown in FIG. 18 is identical with the operation shown in FIG. 13 except that an amount Ga of intake air is read in step 1815, that a correction factor Kga is then set based on the amount Ga of intake air in step 1816, and that an integrated value GaT of amounts of intake air is calculated as $GaT \leftarrow GaT + Kga \times Ga$ in step 1817. Therefore, detailed description of the remaining operations shown in FIG. 18 is omitted herein.

Figure 19:
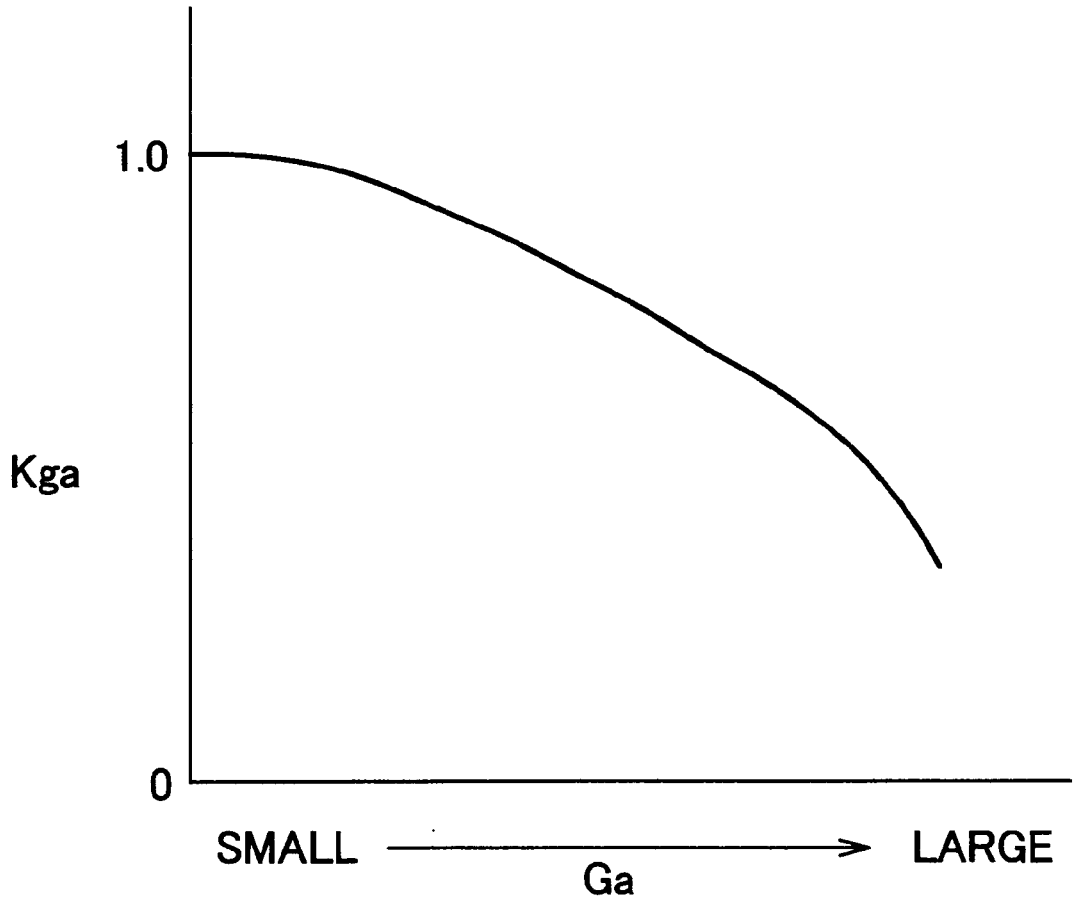
FIG. 19 illustrates how to set a correction factor used for the operation shown in FIG. 18.

FIG. 19 shows a relation between the correction factor Kga set in step 1816 and the amount Ga of intake air.

As shown in FIG. 19, the correction factor Kga is set as a value that decreases in proportion to an increase in the flow rate Ga of intake air. Hence, if the engine is operated with intake air flowing at a high flow rate, that is, if the engine is operated with hot air at a low temperature, the increase in the integrated value GaT of amounts of intake air is smaller as compared with the case where the engine is operated with intake air flowing at a low flow rate. Also, the total amount of hot air supplied to the adsorbent increases in proportion to a fall in temperature of hot air. Therefore, evaporative fuel is reliably desorbed from the adsorbent.

The respective examples of the hot air supplying control operation have been described hitherto. By performing hot air supplying control as described above, the adsorbent 13 is reliably purged of evaporative fuel, so that evaporative fuel is reliably prevented from being discharged to the atmosphere while the engine is out of operation. However, in the case where the hot air supplying device 20 suffers a malfunction, the adsorbent 13 may not actually be supplied with hot air even if hot air supplying control is performed as described above. In this case, the adsorbent 13 is insufficiently purged of evaporative fuel, which may be discharged to the atmosphere while the engine is out of operation. Besides, since the engine can operate without hindrance even if the adsorbent 13 is insufficiently purged of evaporative fuel due to a malfunction of the hot air supplying device 20, the driver may continue to operate the engine without noticing the occurrence of the malfunction. In view of such a problem, the following malfunction diagnosing operation is designed to determine whether or not the hot air supplying device suffers a malfunction, thus detecting a malfunction of the hot air supplying device earlier on.

Figure 20:
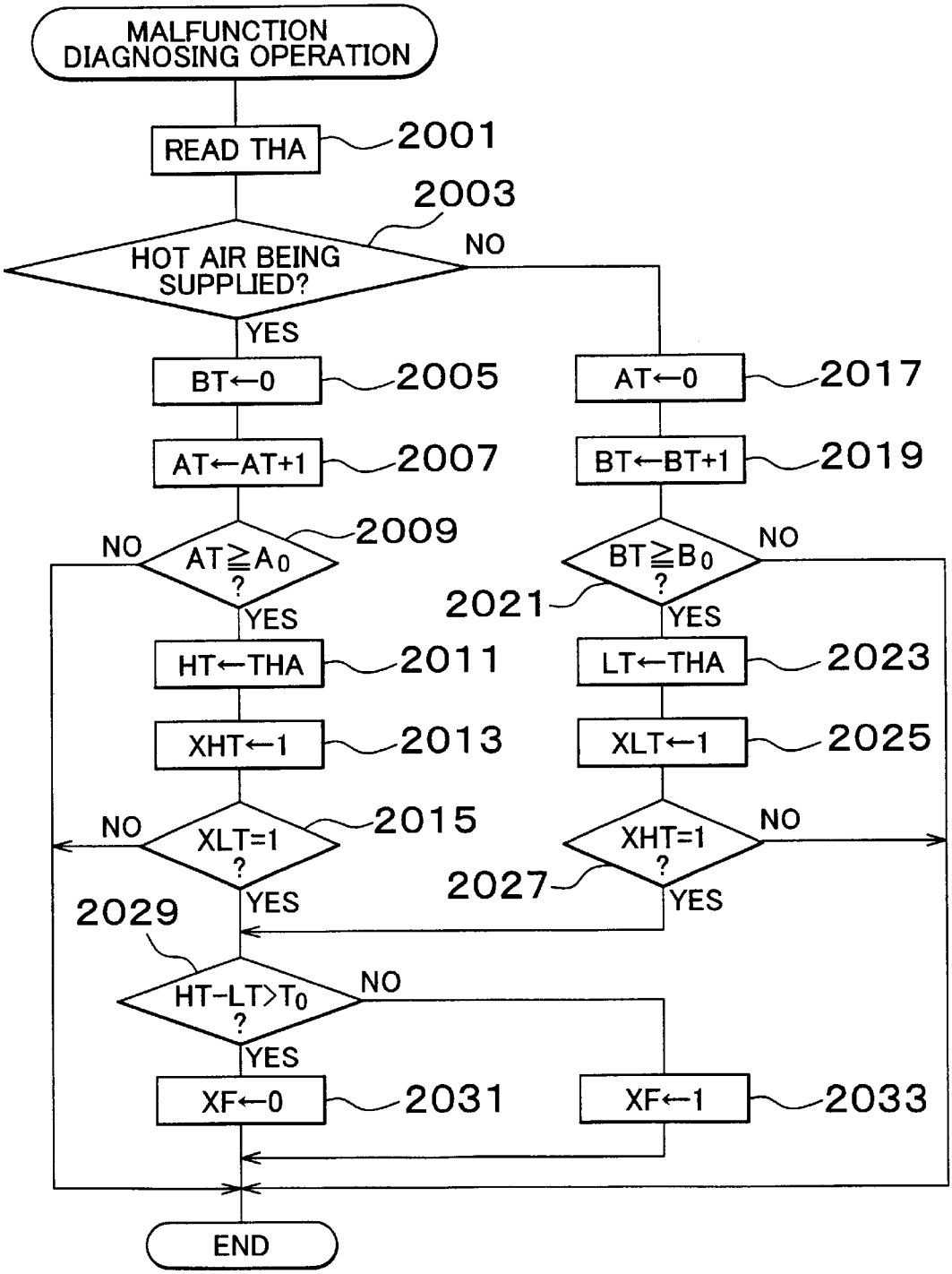
FIG. 20 is a flowchart showing a first example of a malfunction diagnosing operation of the hot air supplying device of the fourth embodiment of the invention.

FIG. 20 is a flowchart showing a first example of a malfunction diagnosing operation of the hot air supplying device. In the operation shown in FIG. 20, if the difference between a temperature of intake air while the hot air supplying device supplies hot air and a temperature of intake air while the hot air supplying device stops supplying hot air is equal to or smaller than a predetermined value, it is determined that the hot air supplying device suffers a malfunction. That is, the malfunction of the hot air supplying device is considered, for example, to be a malfunction of the change-over valve 23, the actuator 23*a* or the like, which brings about a state where the change-over valve 23 remains closed (as indicated by the solid line in FIG. 11) when hot air is to be supplied or a state where the change-over valve 23 remains open (as indicated by the dotted line in FIG. 11) when the supplying of hot air is to be stopped.

In either case, the difference between the temperature of intake air during the supplying of hot air and the temperature of intake air during stoppage of the supplying of hot air is smaller as compared with the case where the hot air supplying device suffers no malfunction. Hence, if the difference between the temperature of intake air during the hot air supplying operation and the temperature of intake air during stoppage of the hot air supplying operation becomes equal to or smaller than the predetermined value, it is possible to determine that the hot air supplying device suffers a malfunction.

Hereinafter, the malfunction diagnosing operation shown in FIG. 20 will be described. This operation is performed in accordance with a routine that is executed by the ECU 30 at predetermined intervals. In the operation shown in FIG. 20, first of all, the temperature THA of intake air detected by the intake air temperature sensor 35*a* is read in step 2001. It is then determined in step 2003 whether or not hot air is currently being supplied (i.e., whether or not a command signal for opening the change-over valve 23 has been output to the actuator 23*a*).

If hot air is currently being supplied in step 2003, a later-described hot air stopping time counter BT is cleared in step 2005, and a hot air supplying time counter AT is incremented by 1 in step 2007. The counter AT is cleared in step 2017 if the hot air supplying operation is stopped in step 2003. Therefore, the value of the counter AT represents a duration time after commencement of the hot air supplying operation.

It is then determined in step 2009 whether or not the hot air supplying time counter AT assumes a value equal to or greater than a predetermined value $A_0$, that is, whether or not hot air has been supplied for a predetermined period corresponding to the predetermined value $A_0$. If hot air has been supplied for the predetermined period in step 2009, it is considered that the temperature of intake air has also stabilized to a temperature corresponding to hot air. Hence, the current temperature THA of intake air read in step 2001 is stored as a temperature HT of intake air during the supplying of hot air in step 2011. A flag XHT for indicating termination of measurement of the temperature of intake air is set as 1 in step 2013. The flag XHT indicates whether or not measurement of the temperature HT of intake air during the supplying of hot air has been terminated. If the flag XHT=1, it is indicated that measurement of HT has been terminated.

On the other hand, if the supplying of hot air is currently stopped in step 2003, it is determined from step 2017 to step 2025 whether or not the supplying of hot air has been stopped for a predetermined period. If the supplying of hot air has been stopped for the predetermined period (YES in step 2021), a current temperature of intake air is stored as a temperature LT of intake air during stoppage of the supplying of hot air in step 2023. Also, a flag XLT for indicating termination of measurement of the temperature of intake air during stoppage of the supplying of hot air is set as 1 in step 2025. It is to be noted that BT in step 2019 and step 2021 denotes a counter indicating a duration time of the stoppage of the supplying of hot air and that the flag XLT is a flag indicating whether or not measurement of the temperature LT of intake air has been terminated while the supplying of hot air is stopped. If the flag XLT=1, it is indicated that measurement of LT has been terminated. It is determined in step 2015 and step 2027 whether or not the flag XLT and the flag HLT are set as 1 respectively. If XLT=1 in step 2015 or if XHT=1 in step 2027, that is, only if measurement of both the temperatures HT and LT has been terminated, the malfunction diagnosing operation starting from step 2029 is performed.

That is, it is determined in step 2029 whether or not the difference between the temperature HT of intake air during the supplying of hot air and the temperature LT of intake air during stoppage of the supplying of hot air is equal to or greater than a predetermined value $T_0$.

If $HT-LT>T_0$ in step 2029, that is, if hot air is being supplied, the temperature of intake air is much higher as compared with the case where the supplying of hot air is stopped. Therefore, it is considered that the hot air supplying device is in normal operation. Thus, in this case, the process proceeds to step 2031 where a malfunction flag XF is set as 0 (normal). Then, the process is terminated. If $HL-LT \leqq T_0$ in step 2029, the temperature of intake air has not risen despite the supplying of hot air. Hence, it is considered that a malfunction of the hot air supplying device such as the sticking of the change-over valve 23 has arisen. Thus, in this case, the process proceeds to step 2033 where the malfunction flag XF is set as 1 (malfunction). Then the process is terminated. If the flag XF is set as 1 (malfunction), a warning lamp disposed close to a driver's seat is lit up by a routine (not shown) that is separately executed by the ECU 30, whereby the driver is advised of a malfunction of the hot air supplying device. The aforementioned criterion value $T_0$ is determined as a relatively small constant value but differs depending on the type of the engine and dimensions of respective portions of the hot air supplying device. Hence, to be more precise, it is preferable that the criterion value $T_0$ be determined experimentally using an actual engine.

The first example of the malfunction diagnosing operation makes it possible to detect a malfunction of the hot air supplying device easily and precisely and thus to detect a malfunction of the device earlier on.

Next, a second example of the malfunction diagnosing operation of the invention will be described. This example is different from the first example of diagnosis shown in FIG. 20 in that diagnosis is prohibited if the temperature of intake air is higher than a predetermined value while the supplying of hot air is stopped. For example, in the case of a vehicular engine or the like, the temperature of an engine compartment is somewhat low due to the wind blowing against the vehicle as running resistance while the vehicle is running, whereas the temperature of the engine room rises because no wind blows against the vehicle as running resistance while the vehicle is stopped. Intake air is usually introduced from inside the engine room. Therefore, if the temperature of the engine room is high, the temperature of intake air rises even in the case where hot air is not supplied. In such a state where the temperature of the engine compartment has risen, the temperature LT during stoppage of the supplying of hot air is high. Hence, even if hot air is supplied in this state, the temperature of intake air rises relatively slightly. Even though the hot air supplying device is in normal operation, the malfunction diagnosis operation shown in FIG. 20 may erroneously determine that there is a malfunction. In view of this problem, this example is designed to withhold (i.e., inhibit) malfunction diagnosis if the temperature LT of intake air during stoppage of the supplying of hot air is higher than a predetermined value $LT_0$, thus eliminating the possibility of erroneous determination.

Figure 21:
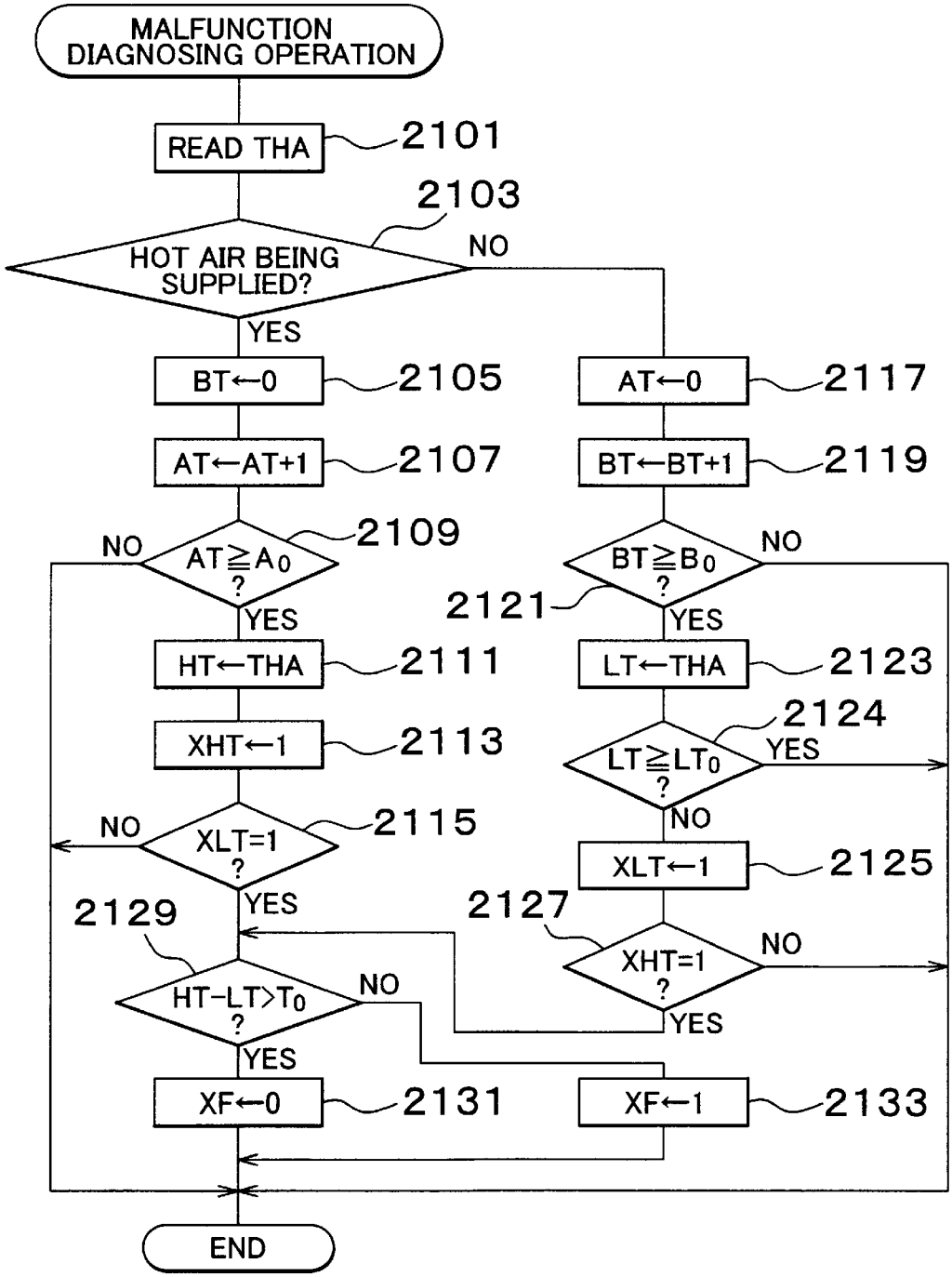
FIG. 21 is a flowchart showing a second example of the malfunction diagnosing operation of the hot air supplying device of the fourth embodiment of the invention.

FIG. 21 is a flowchart illustrating the malfunction diagnosing operation of this example. The operation shown in FIG. 21 is different from the operation shown in FIG. 20 only in that step 2124 is interposed between step 2123 and step 2125. That is, in this example, a temperature LT of intake air during stoppage of the supplying of hot air is stored in step 2123, and it is then determined in step 2124 whether or not the temperature LT is higher than a predetermined temperature $LT_0$. If $LT \geqq LT_0$, the process is terminated immediately instead of proceeding to step 2125. Thereby, the malfunction diagnosing processings starting from step 2129 are not performed if the temperature of intake air during stoppage of the supplying of hot air is high. Therefore, erroneous determination is prevented.

Next, a third example of the aforementioned malfunction diagnosing operation will be described. The aforementioned second example of diagnosis is designed to prohibit malfunction diagnosis if the temperature LT of intake air during stoppage of the supplying of hot air is higher than the predetermined temperature $LT_0$. It is when no wind blows against the vehicle as running resistance while the vehicle is stopped that the temperature of intake air during stoppage of the supplying of hot air rises as described above. Thus, this example is designed to permit or prohibit diagnosis based on the running speed of the vehicle instead of permitting or prohibiting diagnosis based on the temperature LT of intake air. That is, this example of diagnosis is different from the first example of diagnosis shown in FIG. 20 in that measurement of both temperatures HT and LT of intake air is permitted only if the vehicle is running and if a sufficient amount of wind blows against the vehicle as running resistance. Thereby, both the temperatures HT and LT of intake air are measured when wind blows against the vehicle as running resistance. Therefore, erroneous determination is prevented reliably.

Figure 22:
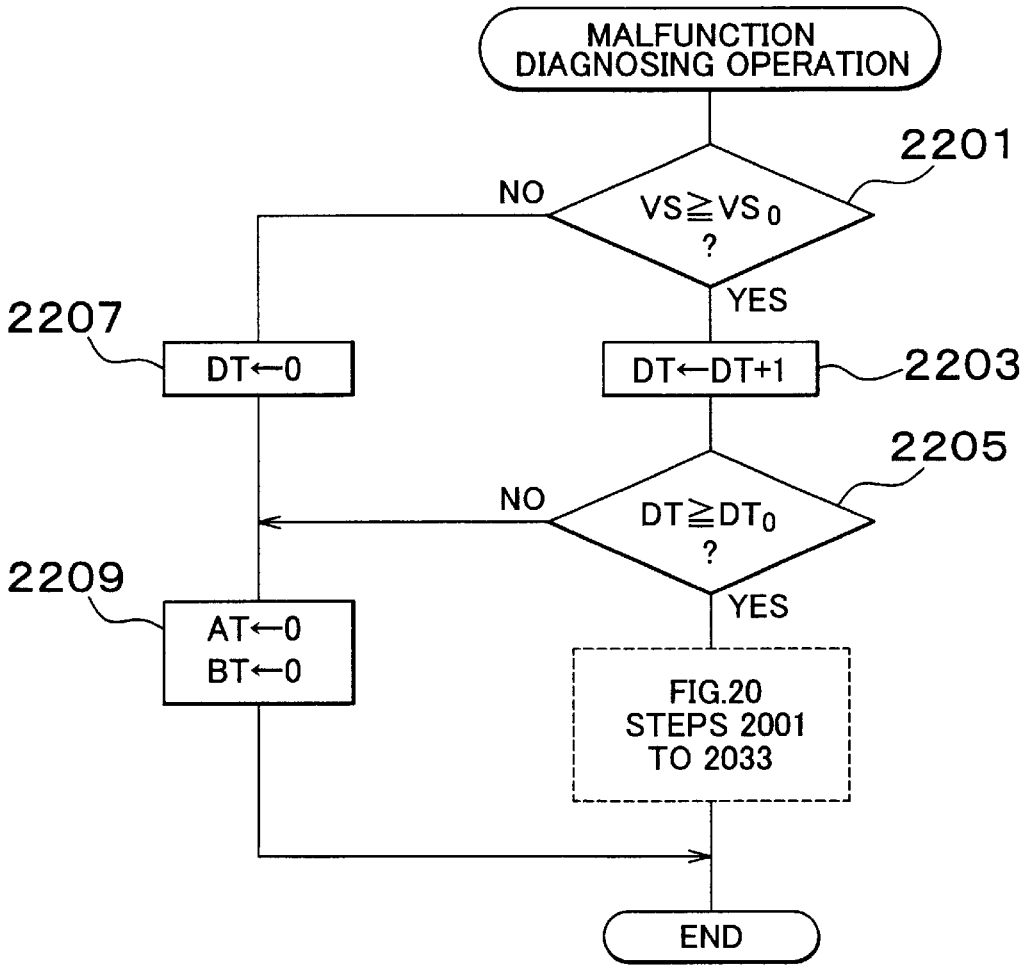
FIG. 22 is a flowchart showing a third example of the malfunction diagnosing operation of the hot air supplying device of the fourth embodiment of the invention.

FIG. 22 is a flowchart illustrating the operation of this example of diagnosis. The operation shown in FIG. 22 is different from the operation shown in FIG. 20 in that steps 2201 to 2207 are added thereto. Hence, the following description will focus on the difference.

In the operation shown in FIG. 22, it is first of all determined in step 2201 whether or not a current running speed VS of the vehicle is equal to or higher than a predetermined value $VS_0$ (e.g., VS0≅5km/h). If $VS<VS_0$, the process proceeds to step 2207 where the value of a later-described counter DT is cleared. Also, the values of the counters AT and BT in the operation shown in FIG. 20 are cleared in step 2209.

If $VS \geqq VS_0$ in step 2201, the process then proceeds to step 2203 where the counter DT is incremented by 1. Thus, the value of the counter DT represents the duration time of a state where the running speed VS of the vehicle is equal to or higher than $VS_0$. It is then determined in step 2205 whether or not the value of the counter DT has reached a predetermined value $DT_0$, that is, whether or not the state where the running speed VS of the vehicle is equal to or higher than $VS_0$ has lasted for a predetermined time corresponding to $DT_0$. If $DT<DT_0$, it is considered that the current running state of the vehicle (with a running speed equal to or higher than 5 km/h) has not lasted sufficiently and that the wind blowing against the vehicle as running resistance has not caused such a fall in temperature of the engine room as to permit malfunction diagnosis. Thus, in this case, the process proceeds to step 2209 where the values of the counters A and B are cleared, and nothing is done until the value of the counter DT reaches $DT_0$. If the value of the counter DT reaches $DT_0$ in step 2205, the processings in steps 2001 to 2033 shown in FIG. 20 are performed.

That is, this example is designed to permit measurement of HT and LT only if the state where the running speed of the vehicle is equal to or higher than the predetermined speed (5 km/h) has lasted for the predetermined time (corresponding to $DT_0$), if the supplying of hot air has lasted for the predetermined time (corresponding to $A_0$), and if the stoppage of the supplying of hot air has lasted for the predetermined time (corresponding to $B_0$). Thereby, in the malfunction diagnosis shown in FIG. 20, both the temperatures HT and LT of intake air are measured when a sufficient amount of wind blows against the vehicle as running resistance. Thus, it becomes possible to diagnose a malfunction of the hot air supplying device more precisely.

Next, a fourth example of the malfunction diagnosing operation of the fourth embodiment will be described. The aforementioned respective examples are designed to determine that a malfunction has arisen if the difference between the temperature HT of intake air during the supplying of hot air and the temperature LT of intake air during stoppage of the supplying of hot air is equal to or smaller than the predetermined value $T_0$, which is a constant value. However, the temperature HT of intake air during the supplying of hot air actually changes depending on the flow rate of intake air. For example, although this embodiment is designed to raise the temperature of intake air through heat exchange between the exhaust manifold and intake air, the period of contact between intake air and the exhaust manifold decreases in proportion to an increase in flow rate of intake air, and thus the temperature HT of hot air falls in proportion to an increase in the flow rate of intake air. Hence, if the same criterion value $T_0$ is used regardless of the flow rate of intake air, the difference between HT and LT decreases despite normal operation of the hot air supplying device as long as the flow rate of intake air is high. The difference may drop below the criterion value $T_0$, leading to the possibility of erroneously determining that a malfunction has arisen. In view of this problem, this example is designed to set the criterion value $T_0$ as a value that decreases in proportion to an increase in flow rate of intake air, thus preventing the aforementioned erroneous determination.

Figure 23:
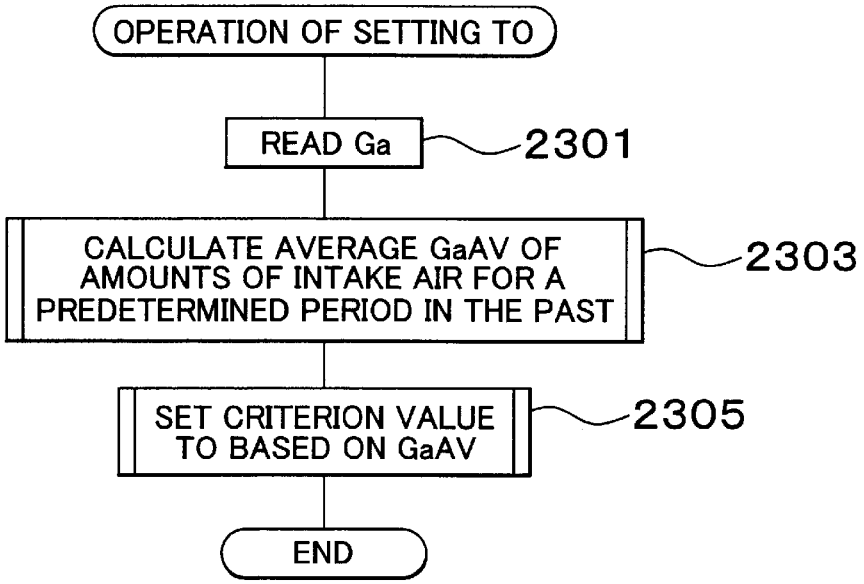
FIG. 23 is a flowchart showing a fourth example of the malfunction diagnosing operation of the hot air supplying device of the first embodiment of the invention.

FIG. 23 is a flowchart showing an operation of setting the criterion value $T_0$ in this example of diagnosis. This operation is performed by a routine that is executed by the ECU 30 at predetermined intervals. The operation shown in FIG. 23 is designed to read an amount Ga of intake air in the engine at predetermined intervals (step 2301), to store the amount Ga of intake air into the RAM, and to calculate an average amount GaAV of intake air read in the past for a predetermined period in step 2303. In step 2305, the criterion value $T_0$ shown in FIG. 20 is calculated based on the calculated average amount GaAV of intake air.

Figure 24:
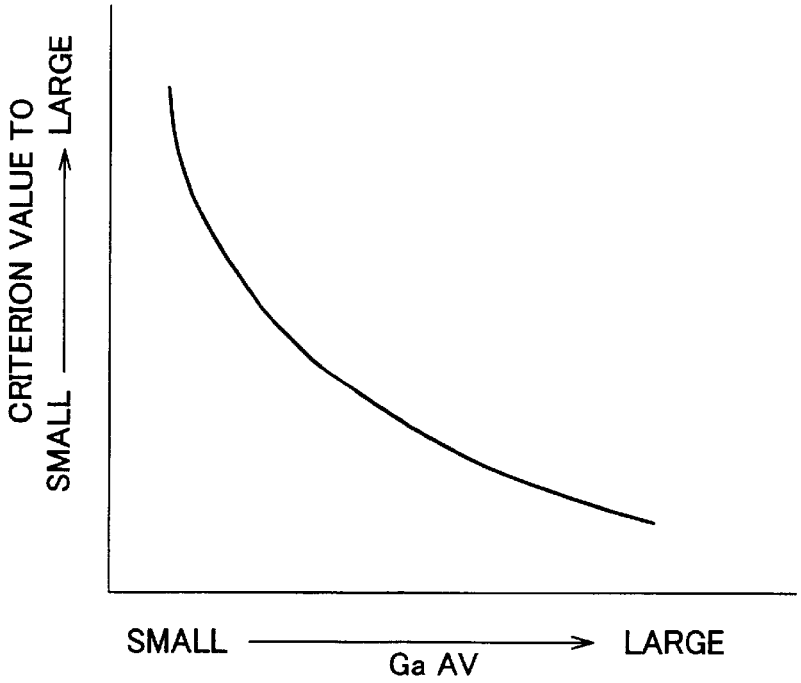
FIG. 24 shows a relation between a criterion value $T_0$ set by the operation shown in FIG. 23 and an average amount GaAV of intake air.

FIG. 24 shows a relation between the criterion value $T_0$ set in step 2305 and the average amount GaAV of intake air. As shown in FIG. 24, the criterion value $T_0$ is set as a value that decreases in proportion to an increase in the average amount GaAV of intake air. The relation shown in FIG. 24 is determined based on a relation which is established between the amount of intake air in the engine and the temperature of hot air and which has been determined experimentally by actually operating the engine. The malfunction diagnosis shown in FIG. 20 is carried out using the criterion value $T_0$ that has been set in accordance with the average amount of intake air in the engine through the operation shown in FIG. 23, whereby precise diagnosis of a malfunction can be carried out regardless of fluctuations in temperature of hot air resulting from the amount of intake air in the engine.

As described hitherto, the fourth embodiment of the invention is designed such that in the case where an adsorbent disposed in an intake passage adsorbs evaporative fuel generated in the intake passage during stoppage of an engine so as to prevent the evaporative fuel from being discharged to the atmosphere, evaporative fuel is reliably desorbed from the adsorbent within a short period while the engine is in operation. Thus, the fourth embodiment of the invention achieves the common effect of making it possible to prevent the adsorbent from being saturated with evaporative fuel.

In addition to the aforementioned common effect, the effect of making it possible to easily and reliably sense the occurrence of a malfunction is achieved.

In the illustrated embodiment, a controller (the ECU 30 or 60) is implemented as a programmed general purpose computer. It will be appreciated by those skilled in the art that the controller can be implemented using a single special purpose integrated circuit (e.g., ASIC) having a main or central processor section for overall, system-level control, and separate sections dedicated to performing various different specific computations, functions and other processes under control of the central processor section. The controller can be a plurality of separate dedicated or programmable integrated or other electronic circuits or devices (e.g., hardwired electronic or logic circuits such as discrete element circuits, or programmable logic devices such as PLDs, PLAs, PALs or the like). The controller can be implemented using a suitably programmed general purpose computer, e.g., a microprocessor, microcontroller or other processor device (CPU or MPU), either alone or in conjunction with one or more peripheral (e.g., integrated circuit) data and signal processing devices. In general, any device or assembly of devices on which a finite state machine capable of implementing the procedures described herein can be used as the controller. A distributed processing architecture can be used for maximum data/signal processing capability and speed.

While the invention has been described with reference to preferred embodiments thereof, it is to be understood that the invention is not limited to the preferred embodiments or constructions. To the contrary, the invention is intended to cover various modifications and equivalent arrangements. In addition, while the various elements of the preferred embodiments are shown in various combinations and configurations, which are exemplary, other combinations and configurations, including more, less or only a single element, are also within the spirit and scope of the invention.

What is claimed is:

1. An evaporative fuel leakage preventing device for an internal combustion engine, comprising:

an intake passage that introduces air from outside the internal combustion engine into a cylinder of the internal combustion engine;

an adsorbent that is disposed in the intake passage and that adsorbs evaporative fuel generated in the intake passage during stoppage of the engine;

a return portion, located lower than a lowermost portion of the adsorbent, formed in the intake passage at a location between the adsorbent and a main body of the internal combustion engine; and an evaporative fuel return passage communicating between the intake passage close to the lowermost portion of the adsorbent and the return portion of the intake passage, wherein:

an atmospheric suction inlet of the intake passage is formed on a side of the adsorbent opposite to a direction in which evaporative fuel generated in the intake passage moves due to application of a gravitational force; and the adsorbent is desorbed of evaporative fuel adsorbed by the adsorbent due to intake air in the internal combustion engine during operation of the internal combustion engine, so that the evaporative fuel is sucked into a cylinder of the internal combustion engine.

2. An evaporative fuel leakage preventing device for an internal combustion engine, comprising:

an intake passage that introduces air from outside the internal combustion engine into a cylinder of the internal combustion engine; and an adsorbent that is disposed in the intake passage and that adsorbs evaporative fuel generated in the intake passage during stoppage of the engine, has a cylindrical shape, and constitutes an inner wall of the intake passage, wherein:

an evaporative fuel adsorbing capacity of the adsorbent is set such that the adsorptive capacity in a lower portion of the adsorbent is larger than the adsorptive capacity in an upper portion of the adsorbent; and the adsorbent is desorbed of evaporative fuel adsorbed by the adsorbent due to intake air in the internal combustion engine during operation of the internal combustion engine, so that the evaporative fuel is sucked into a cylinder of the internal combustion engine.

3. The evaporate fuel leakage preventing device according to claim 2, wherein:

a cross-sectional area of the adsorbent is thicker in the lower portion than in the upper portion.

4. The evaporate fuel leakage preventing device according to claim 3, wherein:

the adsorbent has a triangular cross-sectional shape.

5. An evaporative fuel leakage preventing device for an internal combustion engine, comprising:

an intake passage that introduces air from outside the internal combustion engine into a cylinder of the internal combustion engine;

an adsorbent that is disposed in the intake passage and that adsorbs evaporative fuel generated in the intake passage during stoppage of the engine;

a return portion, located lower than the lowermost portion of the adsorbent, formed in the intake passage at a location between the adsorbent and a main body of the internal combustion engine; and an evaporative fuel return passage communicating between the intake passage close to the lowermost portion of the adsorbent and the return portion of the intake passage, wherein:

an atmospheric suction inlet of the intake passage is located vertically higher than the lowermost portion of the adsorbent, such that evaporative fuel that is desorbed from the adsorbent while the engine is not in operation does not flow toward the atmospheric suction inlet.

6. An evaporative fuel leakage preventing device for an internal combustion engine, comprising:

an intake passage that introduces air from outside the internal combustion engine into a cylinder of the internal combustion engine, the intake passage having an outlet through which the air that has been introduced from the outside of the internal combustion engine exits the intake passage prior to entering the internal combustion engine; and an adsorbent that is disposed in the intake passage and that adsorbs evaporative fuel generated in the intake passage during stoppage of the engine, wherein:

an atmospheric suction inlet of the intake passage is formed on a side of the adsorbent opposite to a direction in which evaporative fuel generated in the intake passage moves due to application of a gravitational force, the atmospheric suction inlet is located higher than the adsorbent and higher than a portion of the intake passage that extends between the adsorbent and the intake passage outlet; and the adsorbent is desorbed of evaporative fuel adsorbed by the adsorbent due to intake air in the internal combustion engine during operation of the internal combustion engine, so that the evaporative fuel is sucked vertically downward from the adsorbent into a cylinder of the internal combustion engine.

7. An evaporative fuel leakage preventing device for an internal combustion engine, comprising:

an intake passage that introduces air from outside the internal combustion engine into a cylinder of the internal combustion engine, the intake passage having an outlet through which the air that has been introduced from the outside of the internal combustion engine exits the intake passage prior to entering the internal combustion engine; and an adsorbent that is disposed in the intake passage and that adsorbs evaporative fuel generated in the intake passage during stoppage of the engine, wherein:

an atmospheric suction inlet of the intake passage is located vertically higher than a lowermost portion of the adsorbent, and vertically higher than a portion of the intake passage that extends between the adsorbent and the intake passage outlet, such that evaporative fuel that is desorbed from the adsorbent while the engine is not in operation does not flow vertically downward toward the atmospheric suction inlet.

* * * * *